US008964511B2

(12) United States Patent
Fujisawa

(10) Patent No.: US 8,964,511 B2
(45) Date of Patent: Feb. 24, 2015

(54) TIMEPIECE WITH A WIRELESS FUNCTION

(75) Inventor: Teruhiko Fujisawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 376 days.

(21) Appl. No.: 13/327,855

(22) Filed: Dec. 16, 2011

(65) Prior Publication Data

US 2012/0170423 A1 Jul. 5, 2012

(30) Foreign Application Priority Data

Jan. 5, 2011 (JP) ..... 2011-000406
Aug. 19, 2011 (JP) ..... 2011-179824

(51) Int. Cl.
*H01Q 1/52* (2006.01)
*G04R 20/02* (2013.01)
*G04C 10/02* (2006.01)
*G04R 60/12* (2013.01)

(52) U.S. Cl.
CPC ..... *G04R 20/02* (2013.01); *G04C 10/02* (2013.01); *G04R 60/12* (2013.01)
USPC ..... 368/47; 368/293

(58) Field of Classification Search
USPC ..... 368/47, 293; 343/702, 841
See application file for complete search history.

(56) References Cited

U.S. PATENT DOCUMENTS 5,798,984 A 8/1998 Koch
6,521,822 B2 * 2/2003 Ito et al. ..... 136/244
6,765,846 B2 * 7/2004 Saitou et al. ..... 368/10
6,992,952 B2 * 1/2006 Endo et al. ..... 368/10
7,333,401 B2 * 2/2008 Kawakami ..... 368/232
7,424,316 B1 * 9/2008 Boyle ..... 455/575.7
8,328,415 B2 * 12/2012 Kachi et al. ..... 368/281
2002/0071346 A1 * 6/2002 Paratte et al. ..... 368/10
2004/0145975 A1 * 7/2004 Barras et al. ..... 368/281
2011/0013491 A1 1/2011 Fujisawa
2011/0102274 A1 5/2011 Fujisawa

FOREIGN PATENT DOCUMENTS

EP 2275884 A2 1/2011
JP 10-160872 6/1998
JP 2000-059241 2/2000
JP 2001-027680 1/2001
JP 2005274247 10/2005
JP 2009168656 7/2009
JP 2011-021929 2/2011
JP 2011-097431 5/2011

* cited by examiner

*Primary Examiner* — Sean Kayes

(57) ABSTRACT

A timepiece with a radio function assures both a good appearance and antenna performance. The GPS wristwatch 1 has a movement 110 for displaying the time, a conductive external case 101 that houses the movement 110, a crystal 130 that is disposed on the face side of the external case 101 and covers the surface of the movement 110, a C-shaped conductive antenna electrode 112, an annular dielectric substrate 111, an GPS antenna 11 disposed between the movement 110 and the crystal 130, and a conductive, round solar panel support substrate 120 disposed between the movement 110 and GPS antenna 11. The outside diameter of the solar panel support substrate 120 is smaller than the inside diameter of the external case 101 on the plane where the solar panel support substrate 120 is disposed.

19 Claims, 18 Drawing Sheets

TIMEPIECE WITH A WIRELESS FUNCTION

BACKGROUND

1. Technical Field

The present invention relates to a timepiece with a wireless function that can receive radio waves.

2. Related Art

Timepieces with wireless communication functions are now common. One use for such wireless communication functions is to receive satellite signals and acquire the current time from positioning information satellites such as GPS (Global Positioning System) satellites.

When the timepiece with a wireless communication function is a wristwatch, for example, an antenna that can provide good reception in a confined space is needed.

Wristwatches that can function as a terminal of a satellite communication system, and wristwatches that can send and receive radio broadcast signals, are taught in Japanese Unexamined Patent Appl. Pub. JP-A-2000-59241, JP-A-2001-27680, and JP-A-H10-160872.

The wristwatch described in JP-A-2000-59241 has a C-shaped loop antenna with a dielectric substrate around the display unit, and uses the metal base of the wristwatch as a ground plate.

The wristwatch described in JP-A-2001-27680 has a GPS antenna disposed beside the display unit of the wristwatch. The GPS antenna is affixed with double-sided tape to the metal case of the wristwatch.

The wristwatch described in JP-A-H10-160872 disposes the antenna and communication circuit together in a plastic bezel, and enables easily adding a transmission and reception mechanism to the wristwatch by simply installing the bezel. The antenna is covered by the bezel and hidden from view.

In addition to such practical functions as displaying the time and communication, however, the feel and appearance of high quality is also desirable in a timepiece.

Metals that have been given a precision finish are often used for the case, dial, and other external parts of such timepieces. The communication antenna and other functional parts are, as much as possible, housed inside or covered so that the appearance is not impaired.

The configurations described in JP-A-2000-59241 and JP-A-2001-27680 have the communication antenna located beside the display unit and obviously exposed to the outside, and therefore cannot be used when a high quality appearance is desired.

The configuration described in JP-A-H10-160872 avoids problems with appearance, but cannot assure sufficient antenna performance. More particularly, while the communication antenna is not exposed with JP-A-H10-160872, there is no ground plate.

In addition, while a metal case and dial afford a desirable appearance, their conductivity blocks electromagnetic waves from reaching the inside. Sufficient antenna performance therefore cannot be achieved when the antenna is housed inside the metal case and dial.

SUMMARY

An object of the present invention is to provide a timepiece with wireless function that can simultaneously provide both a good appearance and good antenna performance.

A timepiece with a wireless function according to one aspect of the invention has a movement for displaying time; a conductive case that houses the movement; a crystal that is disposed on the face side of the case and covers the face side of the movement; an antenna that has an annular or substantially annular conductive antenna electrode and an annular dielectric substrate, and is disposed between the movement and the crystal; and a conductor plate that is conductive, is disposed between the movement and the antenna, and has an outside diameter that is smaller than the inside diameter of the case on the plane where the conductor plate is disposed.

The annular or substantially annular antenna electrode of the antenna includes annular antenna electrodes that are circumferentially continuous, and substantially annular antenna electrodes that are C-shaped, having part of the ring missing.

The conductor plate is disposed between the movement and the antenna in this aspect of the invention. Because there are limitations on the thickness of a timepiece, particularly wristwatches, the distance between the antenna, conductor plate, and movement that are sequentially disposed through the thickness of the timepiece is extremely short relative to the wavelength of radio signals received from GPS and other types of positioning information satellites. As a result, the conductor plate is disposed near the antenna electrode so that the conductor plate has the same current distribution as the antenna electrode and functions as part of the antenna. Because the outside diameter of the conductor plate is smaller than the inside diameter of the case on the plane where the conductor plate is disposed, the conductor does not contact the case or contacts it at one or two points. As a result, the conductive case and the conductor plate do not go to the same potential, the potential of the conductor plate does not drop to ground, problems such as current not flowing through the conductor plate are prevented, and a drop in antenna performance can be prevented.

The antenna electrode is also disposed on the annular dielectric substrate. The antenna electrode must generally be at least as long as the wavelength of the radio waves that are received, and rendering an antenna electrode with sufficient length is difficult in small timepieces such as wristwatches. However, by disposing the antenna electrode on a dielectric substrate, the invention can shorten the wavelength of the input radio waves by means of the dielectric substrate, and radio waves of a specific wavelength can be received with an antenna electrode that is shorter than the wavelength of the radio waves. In addition, because the dielectric substrate is formed in a circle, it can be disposed around the outside edge of the conductor plate, and the appearance of the timepiece is not degraded. A timepiece with wireless function that assures good antenna performance while maintaining a high quality timepiece appearance can therefore be provided.

In a timepiece with wireless function according to another aspect of the invention the conductor plate is disposed with the outside edge separated from the inside circumference surface of the case.

The conductor plate does not touch the conductive case in this aspect of the invention because the outside edge of the conductor plate is separated from the inside surface of the case. Current can therefore reliably be made to flow through the conductor, and a drop in antenna performance can be reliably prevented.

A timepiece with wireless function according to another aspect of the invention preferably also has a spacer intervening between the outside edge of the conductor plate and the inside circumference surface of the case.

By disposing a spacer between the outside edge of the conductor plate and the inside edge of the case, the outside edge of the conductor plate is separated from the inside surface of the case. As a result, the conductor plate can be easily positioned and secured. Manufacturability can therefore be improved, the distance between the conductor plate and the case is stable, variation in antenna characteristics can be prevented, and stable characteristics can be assured.

In a timepiece with wireless function according to another aspect of the invention the conductor plate is preferably disposed in contact with the inside circumference surface of the case at one or only two points.

Because the conductor plate is disposed contacting the inside surface of the case at one or only two points, drop in the potential of the conductor plate is less than when there is contact at three or more points. There is therefore little drop in antenna characteristics, and better antenna performance can be achieved than when a conductor plate is not used. Furthermore, because the conductor plate can contact the inside of the case at one or two points, the conductor plate can be positioned and placed in contact with the case, improving design freedom and improving manufacturability.

A timepiece with wireless function according to another aspect of the invention preferably also has a back cover that is attached to the case and is made of a conductive material that functions as a reflector that reflects radio waves.

In this aspect of the invention the back cover is a conductive member and made to function as a reflector that reflects radio waves. More specifically, because the antenna and the back cover (reflector) are separated a certain distance, the conductive back cover functions as radio wave reflector, and the reception performance of the antenna can be improved. Yet further, because the back cover can be relatively easily designed with a large outside diameter, radio wave reflectivity can be easily improved, and antenna characteristics can be easily improved.

In a timepiece with wireless function according to another aspect of the invention, the outside diameter of the conductor plate is equal to the outside diameter of the antenna electrode or is greater than the outside diameter of the antenna electrode.

In this aspect of the invention the outside diameter of the conductor plate is greater than or equal to the outside diameter of the antenna electrode. As a result, current flow efficiently through the conductor plate that functions as part of the antenna, and antenna characteristics can be improved.

In a timepiece with wireless function according to another aspect of the invention, the conductor plate is a dial for displaying time.

When the dial is metal with a high quality appearance as in this aspect of the invention, the dial can also be used as a conductor plate functioning as part of the antenna, and timepiece construction can be further simplified.

A timepiece with wireless function according to another aspect of the invention preferably also has a transparent dial for displaying time; and a solar panel that is disposed between the dial and the movement, receives light, and generates power; and the conductor plate is a solar panel support substrate that supports the solar panel.

When a solar panel is incorporated in this aspect of the invention, the solar panel support substrate that supports the solar panel can also be used as a conductor that functions as part of the antenna, and timepiece construction can be further simplified.

A timepiece with wireless function according to another aspect of the invention preferably also has a transparent dial for displaying time; and a solar panel that is disposed between the dial and the movement, receives light, and generates power; and the conductor plate is composed of a solar panel support substrate that supports the solar panel, and an annular conductor disposed around the solar panel.

Because the conductor plate is rendered by two members, the solar panel support substrate and the annular conductor, and the annular conductor is disposed around the solar panel when the solar panel is installed in this aspect of the invention, there is no need to expand the solar panel support substrate to between the antenna and the movement. As a result, a common solar panel support substrate that is substantially the same size as the solar panel can be used. Common parts can therefore be used, and cost can also be suppressed.

In a timepiece with wireless function according to another aspect of the invention, the antenna electrode is preferably disposed to a surface of the dielectric substrate of the antenna opposite the crystal.

By disposing the antenna electrode on the surface of the dielectric substrate facing the crystal in this aspect of the invention, the antenna electrode can be separated from the conductive case, radio waves are not easily blocked by the conductive case, and the reception performance of the antenna can be improved.

In a timepiece with wireless function according to another aspect of the invention, the antenna electrode is preferably C-shaped with an opening formed in one part of the circumference; and a power supply point that supplies power to the antenna electrode is disposed at one place at a specific angle having a preset central angle formed by a line connecting a center point of the antenna electrode and the position where the opening is disposed, and a line connecting the center point of the antenna electrode and the power supply point.

By supplying power at a position separated a specific central angle from the opening in the C-shaped antenna electrode, radio waves from GPS satellites, which are circularly polarized waves, can be received. As a result, radio waves from GPS satellites can be received anywhere on Earth, and accurate time information can always be maintained. Note that satellite signals transmitted from positioning information satellites such as GPS (Global Positioning System), the European Galileo system, and SBAS (Satellite-Based Augmentation System) satellites are examples of circularly polarized waves.

DESCRIPTION OF EMBODIMENTS

Preferred embodiments of the present invent ion are described below with reference to the accompanying figures.

Embodiment 1

A first embodiment of the invention is described next with reference to FIG. 1 to FIG. 5.

Figure 1:
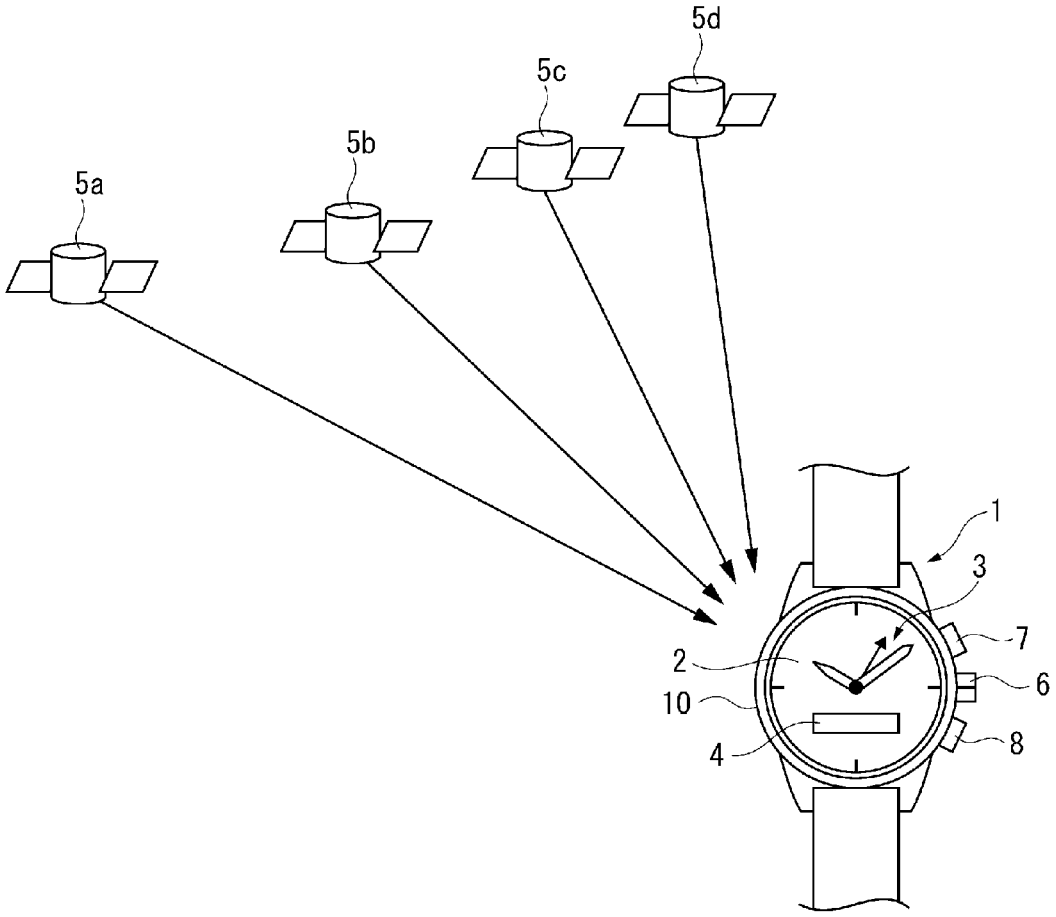
FIG. 1 schematically describes a GPS wristwatch according to a first embodiment of a timepiece with wireless function according to the invention.

As shown in FIG. 1, a GPS wristwatch 1 according to this embodiment of the invention has a time display unit including a dial 2 and hands 3 for displaying the time.

The dial 2 is a round disc made from a non-conductive material such as a plastic or a ceramic that affords a more luxurious appearance. A window is formed in part of the dial 2, and a display 4 such as an LCD (liquid crystal display) panel is disposed in this window as an information display unit.

The hands 3 include a second hand, minute hand, and hour hand, and are driven by a drive mechanism including a stepper motor and wheel train as described below. Note that because the area of the hands 3 is small, the hands 3 do not interfere with RF signal reception even if they are metal, but are preferably made from a non-conductive material because the effects of blocked radio waves can be avoided.

The display 4 is an LCD panel, for example, and displays message information in addition to positioning information such as the longitude and latitude or a city name.

The GPS wristwatch 1 is able to receive satellite signals from a plurality of GPS satellite 5*a*, 5*b*, 5*c*, 5*d* orbiting the Earth on specific paths, acquire satellite time information, and adjust the internal time information.

Note that GPS satellites 5*a*, 5*b*, 5*c*, 5*d* are one example of a positioning information satellite in the invention, and plural satellites are in orbit. There are currently approximately 30 GPS satellites 5*a*, 5*b*, 5*c*, 5*d* in orbit.

A crown 6, and buttons 7 and 8, used for external operations are also disposed to the GPS wristwatch 1.

Internal configuration of the GPS wristwatch 1

The internal configuration of the GPS wristwatch 1 is described next.

Figure 2:
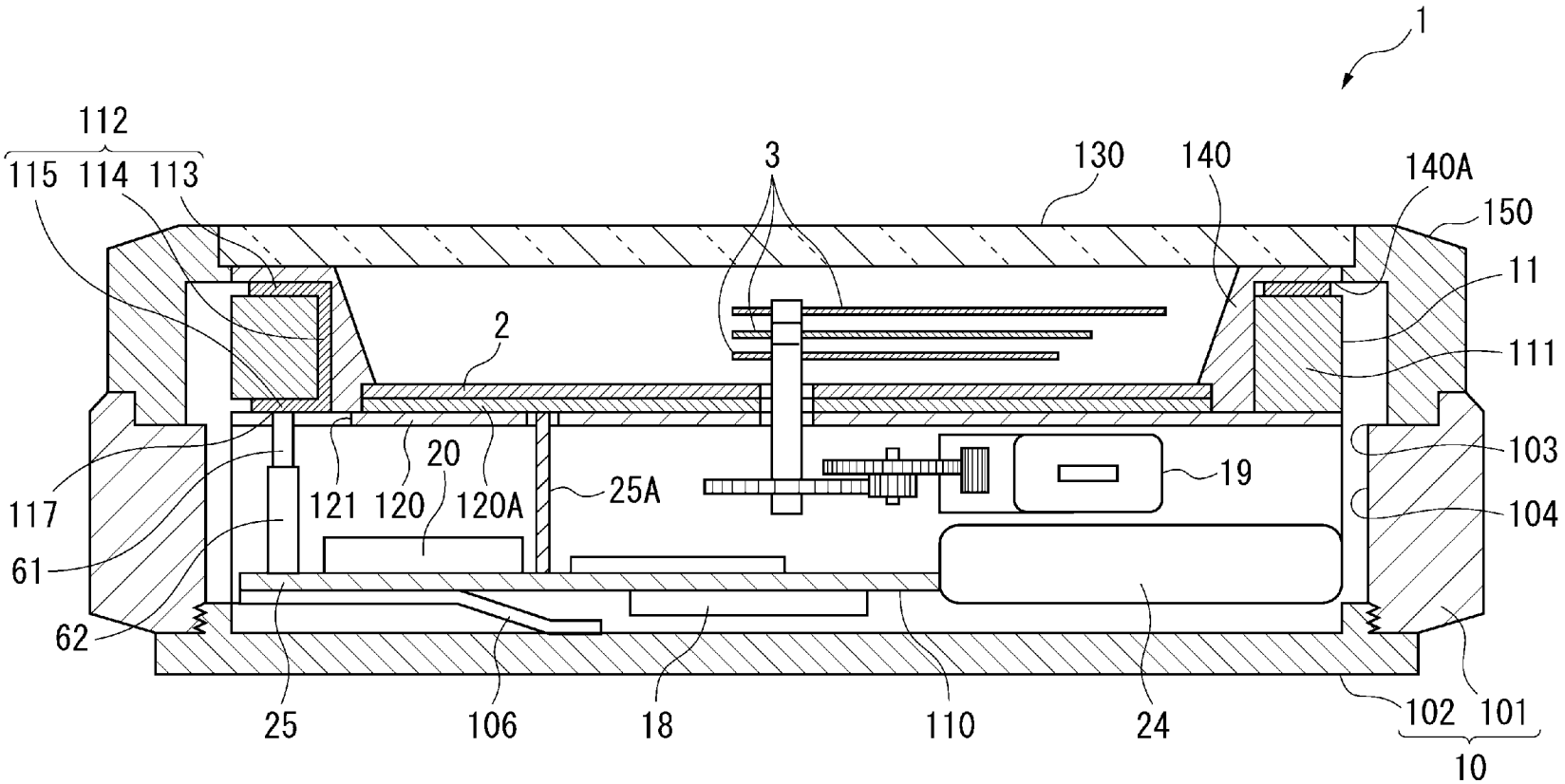
FIG. 2 is a section view of the GPS wristwatch according to the first embodiment of the invention.
Figure 3:
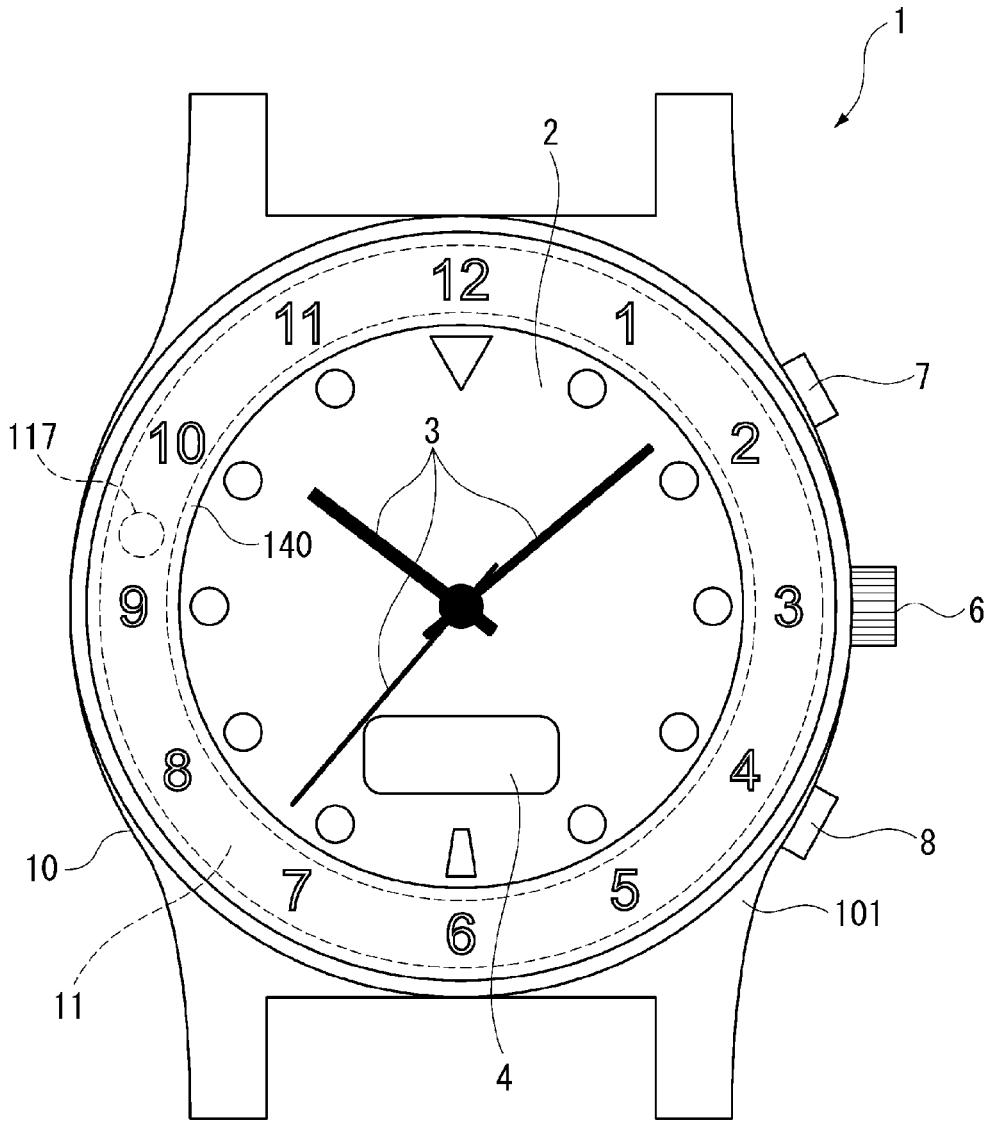
FIG. 3 is a plan view of the GPS wristwatch according to the first embodiment of the invention.
Figure 4:
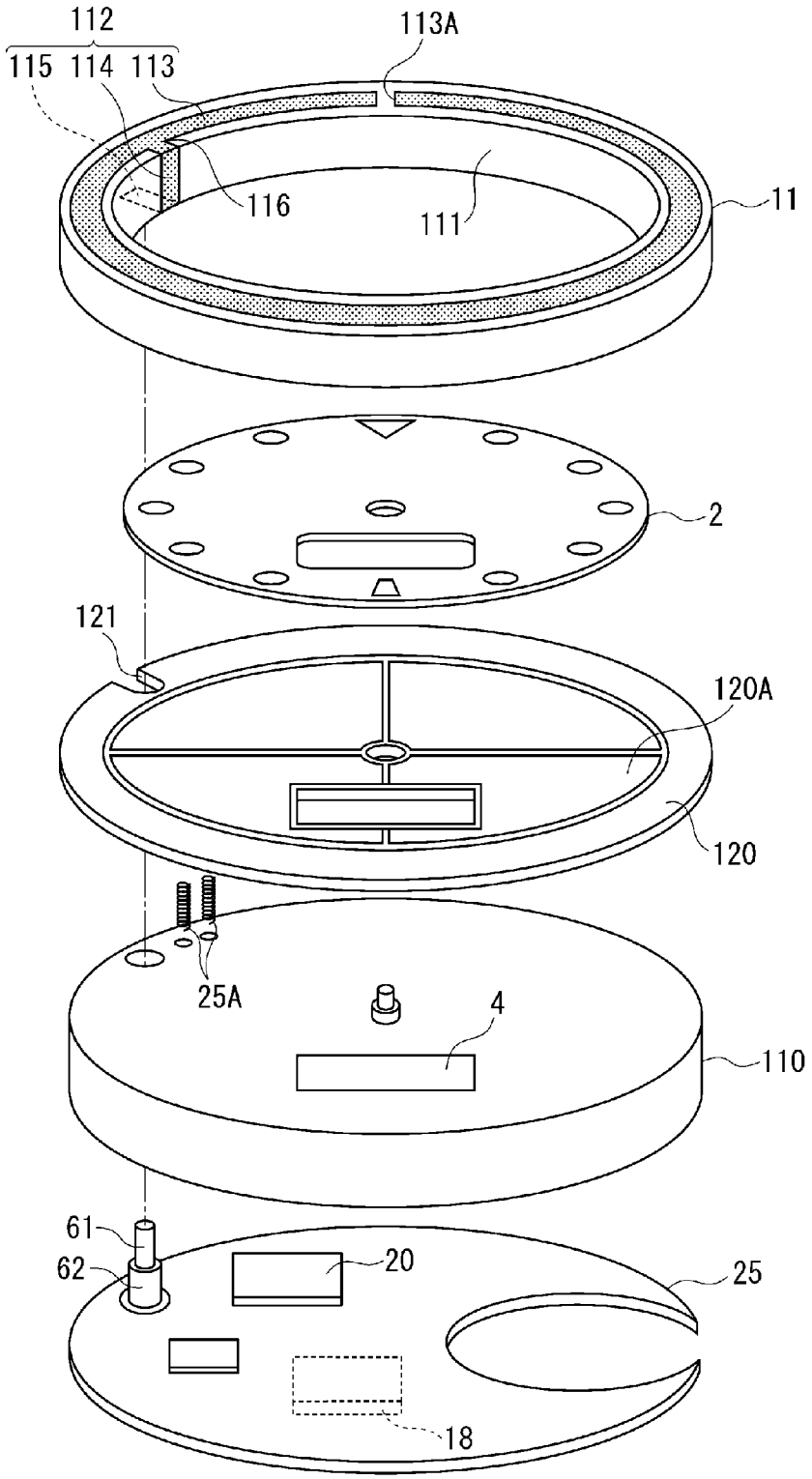
FIG. 4 is an exploded perspective view of the internal construction of the GPS wristwatch according to the first embodiment of the invention.

FIG. 2 is a section view of the GPS wristwatch. FIG. 3 is a plan view of the GPS wristwatch. FIG. 4 is an exploded perspective view of the internal construction of the GPS wristwatch.

As shown in FIG. 2 and FIG. 3, the GPS wristwatch 1 has a movement 110 that drives the hands 3, and a case 10 that houses the movement 110.

The case 10 includes a cylindrical external case 101 as the main case in the invention, and a back cover 102 that covers the opening in the bottom of the external case 101 as seen in FIG. 2.

The external case 101 and back cover 102 are made of a conductive metal such as brass, stainless steel, or titanium alloy. The back cover 102 is screwed into the opening of the external case 101. This forms a cavity 104 with an open face 103 to the other opening (the top side in FIG. 2) in the case 10, and the movement 110 is housed in this cavity 104. The plane shape of the cavity 104, that is, the plane shape of the inside circumference surface of the external case 101, is round because the external case 101 is cylindrically shaped.

The movement 110 displays the time by means of the hands 3, and also receives signals from the GPS satellites 5*a*, 5*b*, 5*c*, 5*d*. The hands 3 are disposed on the face side of the dial 2 (the top side in FIG. 2), and the movement 110 is disposed on the back side (bottom in FIG. 2) of a solar panel support substrate 120.

The movement 110 includes a circuit board 25 on which circuit devices (chips) that execute time display and GPS function processes are mounted, a drive mechanism 19 including a stepper motor and wheel train for driving the hands 3, and a storage battery 24 that supplies power to these other parts.

Circuit devices mounted on the circuit board 25 include a reception unit 18 that processes signals received from the GPS satellites 5*a*, 5*b*, 5*c*, 5*d*, and a control unit 20 that controls the drive mechanism 19.

The reception unit 18 is disposed on the opposite side (the back cover side) of the circuit board 25 as a GPS antenna 11 rendering the antenna of the invention and the display 4 rendered by an LCD panel, for example. The control unit 20 is disposed to the surface of the circuit board 25 on the solar panel support substrate 120 side.

The GPS wristwatch 1 has a solar panel support substrate 120 disposed to the open face 103 of the cavity 104. A solar panel 120A and the dial 2 are disposed on the face side of the solar panel support substrate 120.

The solar panel support substrate 120 is a conductive substrate that is approximately 0.1 mm thick and is made of metal such as brass, stainless steel, or titanium alloy. As described further below, the solar panel support substrate 120 thus has the same current distribution as the GPS antenna 11 disposed nearby, and functions as part of the GPS antenna 11.

Before being assembled into the case 10, the solar panel support substrate 120 is formed as a disk with a diameter slightly less than the inside diameter of the external case 101 at the surface where the solar panel support substrate 120 is disposed. More specifically, if the inside diameter of the external case 101 at the height where the solar panel support substrate 120 is disposed, and the outside diameter of the solar panel support substrate 120 are compared, the outside diameter of the solar panel support substrate 120 is smaller than the inside diameter of the external case 101. More specifically, the solar panel support substrate 120 is made so that it will not touch the external case 101. On the other hand, the inside diameter of the parts of the external case 101 where the solar panel support substrate 120 is not disposed may be smaller than the outside diameter of the solar panel support substrate 120. This is because if these parts are at a different height than the solar panel support substrate 120, the external case 101 will not contact the solar panel support substrate 120.

Note that while the plane shape of the inside circumference of the external case 101 is described as a circle here, the plane shape of the inside circumference of the external case 101 is not limited to round and could be rectangular, for example, except where the solar panel support substrate 120 is located.

The solar panel support substrate 120 is thus disposed with its outside edge separated from and not touching the inside circumference surface of the external case 101.

Note that because the solar panel support substrate 120 is attached to the movement 110, the solar panel support substrate 120 is disposed positioned to a location separated from the external case 101 by positioning the movement 110 to the external case 101.

The solar panel 120A is affixed to the face side of the solar panel support substrate 120 and produces power from light entering through the crystal 130. As shown in FIG. 2 and FIG. 4, the solar panel 120A is connected to a power generation control circuit 51 (FIG. 5) through a conductive coil spring 25A, and the generated power is appropriately charged to the storage battery 24 through the power generation control circuit 51.

The dial 2 is also affixed to the face of the solar panel 120A. The outside diameter of the dial 2 and the solar panel 120A conforms to the inside diameter of a dial ring 140, and their outside edges contact the inside circumference of the dial ring 140 with no gap therebetween so that the solar panel support substrate 120 cannot be seen from the outside. The dial 2 and solar panel 120A have the same outside dimensions. The outside dimension of the solar panel support substrate 120 is greater than the solar panel 120A, and extends to below the GPS antenna 11.

The dial 2 is made from a non-conductive plastic material such as polycarbonate, is transparent to light, and does not interfere with the transmission of incident light to the solar panel 120A.

As will also be known from FIG. 2 and FIG. 4, a notch 121 that communicates the space on the crystal 130 side with the space on the movement 110 side is formed in part of the outside edge of the solar panel support substrate 120, specifically between the 9:00 and 10:00 markers on the dial 2 when seen in plan view.

The GPS wristwatch 1 also has a GPS antenna 11 disposed around the outside of the solar panel support substrate 120.

The GPS antenna 11 receives signals from the GPS satellites 5*a*, 5*b*, 5*c*, 5*d* described above, and is disposed on the face side of the solar panel support substrate 120 so that the outside edge of the solar panel support substrate 120 and the outside edge of the GPS antenna 11 are substantially coincident. More specifically, the outside diameter of the solar panel support substrate 120 and the outside diameter of the GPS antenna 11 are the same, and are greater than the outside diameter of the antenna electrode 112 of the GPS antenna 11.

The outside diameter (outside dimension), which is the greatest dimension of the GPS antenna 11, is less than the outside diameter (outside dimension) of the back cover 102. In other words, the outside diameter of the back cover 102 is greater than GPS antenna 11. The GPS antenna 11 is described in further detail below.

The GPS wristwatch 1 also has a dial ring 140 that holds the GPS antenna 11.

The dial ring 140 is formed in a circle with an inside diameter substantially the same as the dial 2, and a recessed part 140A around the outside that holds the GPS antenna 11. The dial ring 140 is disposed on the face side of the dial 2 (the crystal 130 side in the thickness direction of the GPS wristwatch 1) around the outside of the dial 2. The inside circumference of the dial ring 140 is tapered (conically shaped) toward the dial 2, and 60 markers are printed on this tapered surface.

A bezel 150 is disposed around the dial ring 140, and the crystal 130 is disposed inside the bezel 150 covering the hands 3 and the face side of the dial 2.

The bezel 150 is ring-shaped with the outside contiguous to the outside of the external case 101. Matching shoulders are formed on the opposing faces of the bezel 150 and external case 101, and the bezel 150 is affixed to the external case 101 by fitting or bonding the shoulders together with double-side tape or adhesive. The bezel 150 holds the crystal 130 and positions the dial ring 140 by contacting the outside surface of the dial ring 140.

The GPS antenna 11 disposed in the recessed part 140A of the dial ring 140 is covered by the dial ring 140 and the bezel 150.

As a result, the crystal 130 is disposed covering the face side of the movement 110, the solar panel support substrate 120 that functions as part of the GPS antenna 11 is disposed between the crystal 130 and the movement 110, and the hands 3 and GPS antenna 11 are disposed between the solar panel support substrate 120 and crystal 130.

In this GPS wristwatch 1 the back cover 102 and external case 101 of the case 10 are made from metals with an excellent texture and appearance, and a desirable surface finish is applied to the surface.

The dial ring 140 and bezel 150 are made from non-conductive materials, and the crystal 130 is also made from non-conductive glass. These parts are also appropriately surface finished to impart the desired look and feel. While plastics can be used as the non-conductive material of the bezel 150, the bezel 150 is preferably made from a hard ceramic material with greater scratch resistance and a more luxurious feel.

By using such materials, the dial ring 140, bezel 150, and crystal 130 on the face side of the dial 2 (the top in FIG. 2) are all made from non-conductive material, and therefore do not have an electromagnetic shielding effect on the GPS antenna 11 disposed around the outside face side of the solar panel support substrate 120.

GPS Antenna Configuration

As shown in FIG. 4, the GPS antenna 11 has a ring-shaped dielectric substrate 111 that is rectangular in section with an antenna electrode 112 formed on the surface thereof.

The dielectric substrate 111 functions to shorten the wavelength of received signals. More specifically, the satellite signals transmitted from the GPS satellites 5*a*, 5*b*, 5*c*, 5*d* are circularly polarized waves with a frequency of 1575.42 MHz and 19 cm wavelength. In order to receive such satellite signal waves using a loop antenna, the circumference of the antenna electrode 112 must be 1.0 to 1.4 times the wavelength of the satellite signals. However, by disposing the antenna electrode 112 on the dielectric substrate 111, the dielectric substrate 111 shortens the wavelength of the satellite signal, and enables receiving this shortened wavelength with the antenna electrode 112. For a dielectric substrate 111 with a dielectric constant $\in_r$, the wavelength shortening rate is $1/(\in_r)^{1/2}$. The wavelength can therefore be shortened more by increasing the dielectric constant $\in_r$. However, if a dielectric with a high dielectric constant $\in_r$ is used, the frequency band becomes narrower with a steeper slope, tuning is more difficult, and reception performance drops due to frequency shifting when worn on the wrist. Therefore, to receive satellite signals with a 19 cm wavelength using the antenna electrode 112 of a loop antenna with a 3 cm diameter (approximately 9.4 cm circumference), the dielectric constant $\in_r$ of the dielectric substrate 111 is preferably less than or equal to 20, and is further preferably in the range 4 to 10. This means that an alumina ceramic ($\in_r$=8.5), a mica ceramic such as Micalex ($\in_r$=6.5-

9.5), glass ($\in_r$=5.4-9.9), or diamond ($\in_r$=5.68), for example, can be used for the dielectric substrate 111. By using this type of dielectric substrate 111, the gap between the antenna electrode 112 and the solar panel support substrate 120 is 0.21 cm-0.42 cm.

This easily enables using the dielectric substrate 111 in a wristwatch because the thickness of a typical wristwatch is 0.7-1.5 cm.

The height of the dielectric substrate 111, that is, the distance (height) from the bottom surface opposite the solar panel support substrate 120 to the top surface opposite the crystal 130, is set to the distance required for the solar panel support substrate 120 to function as part of the antenna electrode 112. More specifically, the height from the solar panel support substrate 120 to the antenna electrode 112 is 0.05-0.01 times the wavelength received by the antenna electrode 112, that is, the signal wavelength after wavelength shortening by the dielectric substrate 111. If this height is used, the current distribution will be substantially the same in the solar panel support substrate 120 as the GPS antenna 11 because the distance is short, and the solar panel support substrate 120 will function as part of the GPS antenna 11. For example, if the dielectric constant $\in_r$ of the dielectric substrate 111 is 20, satellite signals with a 19 cm wavelength will be shortened by the dielectric substrate 111 to signals with a wavelength of approximately 4.25 cm. If the distance from the solar panel support substrate 120 to the antenna electrode 112 in this case is 0.21 cm-0.42 cm, which is 0.05-0.1 times the shortened wavelength, the solar panel support substrate 120 will function as part of the GPS antenna 11. Note that in a GPS wristwatch 1 according to this embodiment of the invention the height of the dielectric substrate 111 is approximately 0.2-1.0 cm, and more preferably is 0.3 cm.

The antenna electrode 112 is formed in a line in unison with the dielectric substrate 111 by printing a conductive metal device of copper or silver, for example, on the surface of the dielectric substrate 111, or adhesively of fixing a conductive metal plate of silver or copper, for example, on the surface of the dielectric substrate 111. Note that the antenna electrode 112 may also be a pattern formed by electroless plating on the surface of the dielectric substrate 111.

This antenna electrode 112 includes the antenna wire 113, a coupling 114, and a power supply part 115.

The antenna wire 113 is the line portion formed on the surface of the dielectric substrate 111 (the surface opposite the crystal 130). The antenna wire 113 is C-shaped, that is, a circle with an opening 113A formed in one place. The antenna wire 113 picks up radio waves entering from the crystal 130 side and radio waves reflected from the back cover 102.

A branch point 116 is formed at one place on the inside circumference side of the antenna wire 113 at a position separated a specific center angle from where the opening 113A is located. The coupling 114 is formed extending from this branch point 116 to the inside circumference surface of the dielectric substrate 111. The branch point 116 is formed at a position ¼ wavelength from one end of the C-shaped antenna wire 113, and circularly polarized waves can be received by connecting the coupling 114 at this branch point 116.

The end of the coupling 114 on the opposite end as the branch point 116 extends to the bottom surface of the dielectric substrate 111, and the power supply part 115 that continues to the coupling 114 is formed on the bottom surface of the dielectric substrate 111.

As shown in FIG. 3 and FIG. 4, the power supply part 115 is formed at a position opposite the notch 121 in the solar panel support substrate 120 between the 9:00 and 10:00 markers of the dial 2 when seen in plan view. The end of a connection pin 61 passing through the notch 121 contacts the power supply part 115. The place where the power supply part 115 and connection pin 61 contact is the power supply point 117 (see FIG. 2, FIG. 3). This power supply point 117 is disposed to the antenna electrode 112 at only one location.

The connection pin 61 is disposed between the 9:00 and 10:00 markers on the dial 2 when seen in plan view, and is supported so that it can rise freely in a connection base 62 that is connected to and rises from a wiring line printed on the circuit board 25. By disposing the connection pin 61 between the 9:00 and 10:00 on the dial 2, structural interference with the crown 6 disposed at 3:00 and the buttons 7 and 8 disposed at 2:00 and 4:00 for external operations can be avoided.

The connection pin 61 and connection base 62 are electrically connected through printed wires to the reception unit 18. The connection base 62 is substantially cylindrically shaped, and has an urging member such as a coil spring disposed inside that urges the connection pin 61 to the power supply part 115 side. As a result, the connection pin 61 is pushed to the power supply point 117, and the connection between the connection pin 61 and power supply point 117 is maintained even an external impact is applied to the GPS wristwatch 1.

In this embodiment of the invention the back cover 102 made of a conductive material also functions as the ground plate (reflector) of the GPS antenna 11. The back cover 102 is connected to a ground terminal 106 disposed to the movement 110. The ground terminal 106 is connected to the ground potential of the reception unit 18 of the movement 110. As a result, the back cover 102 is electrically connected to the ground potential of the reception unit 18 through the ground terminal 106, and functions as a ground plate (reflector) that reflects radio waves incident from the crystal 130 side to the GPS antenna 11. Note that because the conductive external case 101 in contact with the back cover 102 also goes to the ground potential, the external case 101 also functions as a ground plate.

The outside diameter of the back cover 102 is greater than the outside diameter of the GPS antenna 11.

The antenna electrode 112 of the GPS antenna 11 is superimposed on the back cover 102 when seen in plan view, that is, in the thickness direction of the GPS wristwatch 1.

In addition, because the case 10 including the back cover 102 and external case 101 is metal, it functions as a ground plate and avoids affecting the GPS antenna 11 when worn on the user's wrist. More specifically, if the case 10 is a plastic case, the resonance frequency of the GPS antenna 11 varies when the case 10 is worn and is not worn due to the effect of the adjacent arm, resulting in undesirable differences in performance. However, because the case 10 is metal, the effect of the arm is avoided by the shield effect of the case 10, there is substantially no difference in antenna performance in this embodiment of the invention when worn and not worn, and stable reception performance is achieved.

Note that an LCD panel, for example, is disposed as the display 4 on the back side of the dial 2, and this LCD panel is covered by a shield to block the effects of noise. In this case, the solar panel support substrate 120 also functions as a display 4 shield.

The stepper motor of the drive mechanism 19 can also be a source of noise, but because the drive mechanism 19 is disposed on the opposite side (back side) of the solar panel support substrate 120 as the GPS antenna 11, the drive mechanism 19 is shielded by the solar panel support substrate 120 and its effect on the GPS antenna 11 is suppressed.

Circuit Configuration of the GPS Wristwatch

Figure 5:
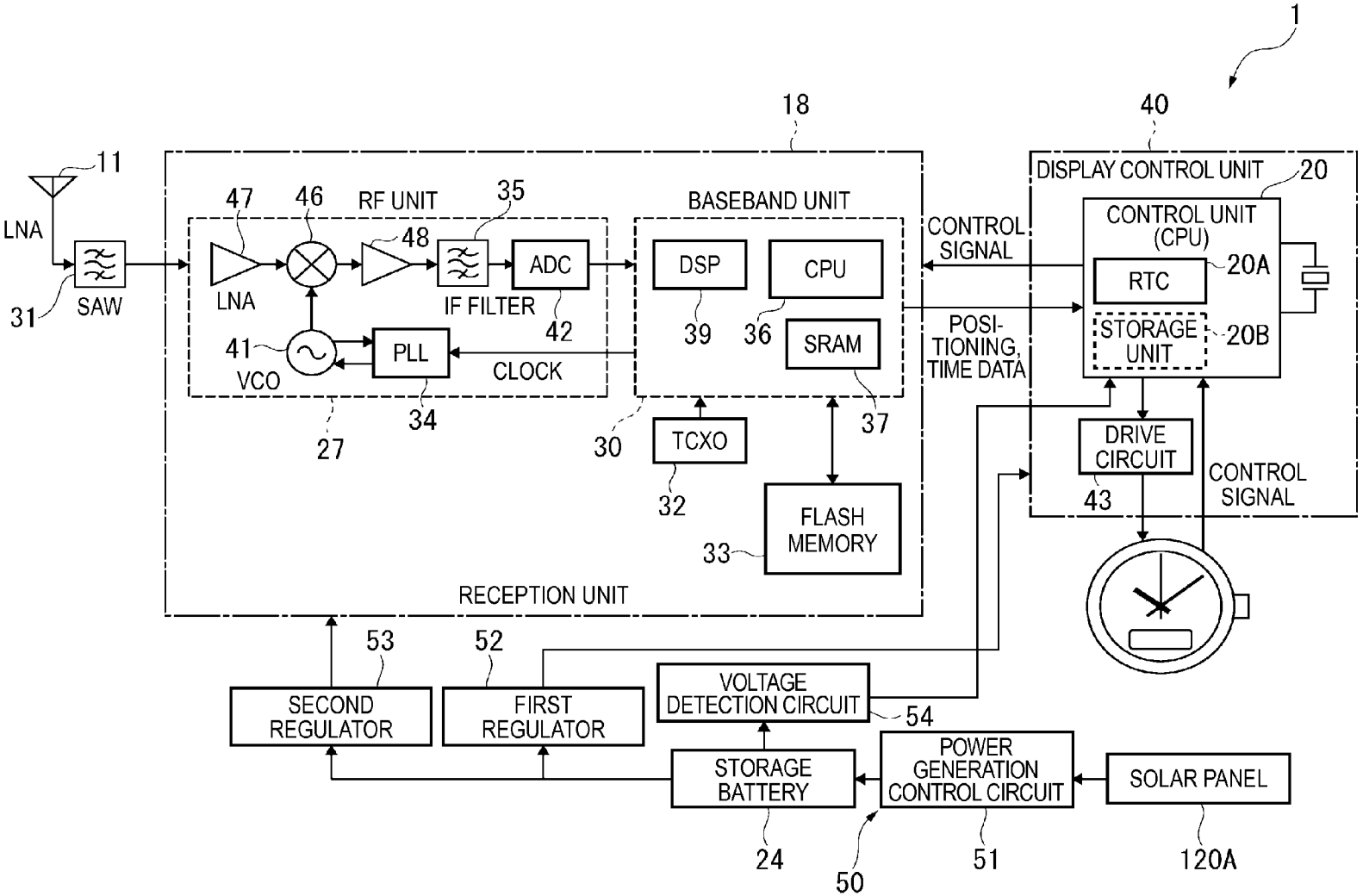
FIG. 5 is a block diagram of the hardware configuration of the GPS wristwatch according to the first embodiment of the invention.

The circuit design of the GPS wristwatch 1 is described next. As shown in FIG. 5, the GPS wristwatch 1 includes a GPS antenna 11, SAW filter 31, reception unit 18, display control unit 40, and power supply unit 50.

The SAW filter 31 is a bandpass filter, and extracts 1.5 GHz satellite signals. As also described above, a low noise amplifier (LNA) may also be disposed between the GPS antenna 11 and SAW filter 31 to improve reception sensitivity.

Note, further, that the SAW filter 31 may be incorporated in the reception unit 18.

The reception unit 18 processes the satellite signals extracted by the SAW filter 31, and includes an RF (radio frequency) unit 27 and baseband unit 30.

The RF unit 27 includes a PLL (phase-locked loop) circuit 34, IF (intermediate frequency) filter 35, VCO (voltage-controlled oscillator) 41, A/D converter (analog/digital converter) 42, mixer 46, LNA (low noise amplifier) 47, and IF amplifier 48.

The satellite signals extracted by the SAW filter 31 are amplified by the LNA 47, mixed with the VCO 41 signal by the mixer 46, and down-converted to an IF (intermediate frequency) signal.

The IF signal output from the mixer 46 passes through the IF amplifier 48 and IF filter 35, and is converted to a digital signal by the A/D converter 42.

The baseband unit 30 includes a DSP (Digital Signal Processor) 39, CPU (Central Processing Unit) 36, and SRAM (Static Random Access Memory) 37. The baseband unit 30 is also connected to a temperature-compensated crystal oscillator (TCXO) 32 and flash memory 33.

Digital signals from the RF unit 27 and A/D converter 42 are input to the baseband unit 30, which is configured to perform operations on the satellite signals based on control signals and extract satellite time information and positioning information.

The TCXO 32 generates a clock signal for the PLL circuit 34.

The display control unit 40 includes a control unit 20 (CPU), and a drive circuit 43 that drives the hands 3 and the LCD panel of the display 4.

Hardware components of the control unit 20 include a real-time clock (RTC) 20A and storage unit 20B.

The RTC 20A keeps the internal time using a reference signal output from a crystal oscillator.

The storage unit 20B stores time data and positioning data output from the reception unit 18. Time difference data corresponding to the positioning information is also stored in the storage unit 20B, and the current local time can be calculated from this time difference data and the internal time kept by the RTC 20A.

The reception unit 18 and display control unit 40 described above enable the GPS wristwatch 1 according to this embodiment of the invention to automatically correct the displayed time based on the reception signals from the GPS satellites.

The power supply unit 50 includes a solar panel 120A, the power generation control circuit 51, storage battery 24, a first regulator 52, second regulator 53, and voltage detection circuit 54.

The storage battery 24 supplies drive power to the display control unit 40 through the first regulator 52, and supplies drive power to the reception unit 18 through the second regulator 53.

The solar panel 120A supplies power to the storage battery 24 through the power generation control circuit 51, and charges the storage battery 24.

The voltage detection circuit 54 monitors the voltage of the storage battery 24 and outputs to the control unit 20. The control unit 20 thus determines the storage battery 24 voltage and controls the reception process.

Operating Effect of Embodiment 1

As described above, the solar panel support substrate 120 is disposed between the movement 110 and crystal 130 in the GPS wristwatch 1 according to the first embodiment of the invention. A ring-shaped dielectric substrate 111 and a GPS antenna 11 with a C-shaped antenna electrode 112 formed on the surface of the dielectric substrate 111 are also disposed between the solar panel support substrate 120 and crystal 130.

As a result, the distance between the solar panel support substrate 120 and the antenna electrode 112 of the GPS antenna 11 is extremely short (approximately 0.01 times) the wavelength of the RF signals, that is, the satellite signals received from the GPS satellites 5*a*, 5*b*, 5*c*, 5*d*. Because the solar panel support substrate 120 is disposed near the antenna electrode 112, the solar panel support substrate 120 has the same current distribution as the antenna electrode 112 and functions as part of the GPS antenna 11.

The outside diameter of the solar panel support substrate 120 is also smaller than the inside diameter of the external case 101 on the plane where the solar panel support substrate 120 is located. The solar panel support substrate 120 therefore does not touch the external case 101. More specifically, the outside edge of the solar panel support substrate 120 is separated from the inside surface of the external case 101, and the solar panel support substrate 120 is disposed without touching the external case 101.

As a result, such problems as the solar panel support substrate 120 touching the conductive external case 101, the potential of the solar panel support substrate 120 going to ground, and current not flowing through the solar panel support substrate 120 can be prevented. Current therefore flows reliably through the solar panel support substrate 120, the solar panel support substrate 120 reliably functions as part of the GPS antenna 11, and antenna performance can be reliably improved.

More specifically, the solar panel support substrate 120 that functions as part of the GPS antenna 11 is disposed with a specific gap to the metal external case 101 and back cover 102. As a result, the external case 101 and back cover 102 function together as aground plate (reflector), the solar panel support substrate 120 that functions as part of the GPS antenna 11 is separated a specific distance from the external case 101 and back cover 102, and antenna performance can be improved.

The GPS wristwatch 1 according to the first embodiment of the invention also uses a GPS antenna 11 having a C-shaped antenna electrode 112.

The length of the antenna electrode 112 must also be at least equal to the wavelength of the received signals, and if the length of the antenna electrode 112 is shorter than this wavelength, a dielectric substrate 111 with a dielectric constant $\in_r$ high enough to shorten the wavelength according to the antenna length is needed. This narrows the range of dielectric substrate 111 materials that can be used, and increases cost. However, sufficient length can be more easily assured by using a C-shaped antenna electrode 112 than a rod antenna or arc-shaped antenna, and the dielectric substrate 111 can be selected from a wider range of materials. A lower-cost, suitable dielectric substrate 111 can therefore be selected, thus decreasing the production cost.

The outside shape of the solar panel support substrate 120 is also substantially the same as the shape of the inside surface of the external case 101. As a result, the antenna electrode 112 can be disposed along the outside of the solar panel support substrate 120, and the inside circumference side of the external case 101 can be used effectively.

Furthermore, because the antenna electrode 112 is disposed along the outside edge of the solar panel support substrate 120, the GPS antenna 11 can be easily hidden by a separate non-conductive member such as a dial ring. The GPS antenna 11 is therefore not exposed to the face of the timepiece, and a high quality appearance can be maintained for the timepiece.

The GPS antenna 11 is also disposed inside the crystal 130. Because the GPS antenna 11 will therefore not be bared to the outside, GPS antenna 11 durability can be improved and the design limitations created by the GPS antenna 11 can be reduced.

Furthermore, a metal external case 101 and back cover 102 can be used for the case 10, and the appearance of the timepiece can be held at a high level.

A GPS wristwatch 1 with good antenna performance can therefore be provided while the appearance of the timepiece is held at a high level.

The back cover 102 is also made of a conductive material and made to function as a reflector that reflects radio waves. More specifically, because the GPS antenna 11 and the back cover 102 are separated a certain distance, the conductive back cover 102 functions as a radio wave reflector, and the reception performance of the GPS antenna 11 can be improved.

In addition, because the back cover 102 functions as a reflector, change in the tuning frequency of the antenna can be prevented even when used in a wristwatch, antenna performance can be improved, and good reception characteristics can be achieved. More particularly because the back cover 102 can be easily designed with a relatively large outside dimension, radio wave reflectivity can be easily improved, and antenna characteristics can be easily improved.

The GPS wristwatch 1 according to this embodiment of the invention also uses the solar panel support substrate 120 that supports the solar panel 120A as a conductor.

This configuration enables using the solar panel support substrate 120 as part of the GPS antenna 11 and as a support substrate for the solar panel 120A, and eliminates the need to use a dedicated substrate to support the solar panel 120A and another substrate as the conductor. An increase in the parts count can therefore be suppressed, and the configuration can be simplified.

The antenna electrode 112 of the GPS antenna 11 includes a ring-shaped antenna wire 113 disposed on the surface of a ring-shaped dielectric substrate 111, a coupling 114 formed from the branch point 116, which is a point on the inside circumference of the antenna wire 113, contiguously to the inside circumference surface of the dielectric substrate 111, and a power supply part 115 formed on the bottom of the dielectric substrate 111 contiguously from the opposite end of the coupling 114 as the branch point 116. A notch 121 is disposed to the solar panel support substrate 120 at a position opposite the power supply part 115, and a connection pin 61 that is urged from the movement 110 side to the power supply point 117 is disposed through this notch 121.

As a result, contact between the power supply part 115 and the solar panel support substrate 120, and contact between the connection pin 61 and the solar panel support substrate 120, can be prevented while the connection pin 61 can assure a positive electrical connection between the antenna electrode 112 and the reception unit 18 of the circuit board 25. In addition, because the connection pin 61 is urged to the power supply point 117 side, a good connection between the 71 and the power supply point 117 can be maintained even when an external impact is applied to the timepiece, for example.

The reception unit 18 is disposed on the back cover 102 side of the circuit board 25, and the solar panel support substrate 120 is disposed between the reception unit 18 and the GPS antenna 11.

As a result, the solar panel support substrate 120 functions as a shield blocking noise produced by the internal clock of the reception unit 18. The GPS antenna 11 is therefore not affected by noise from the reception unit 18, and antenna characteristics can be further improved.

The GPS antenna 11 is disposed on the face side of the dial 2, and is surrounded by a dial ring 140 and bezel 150 made from non-conductive materials.

The GPS antenna 11 is therefore not subject to electromagnetic shielding even when metals with an outstanding appearance are used for the external case 101, and good antenna performance can be assured.

Embodiment 2

Figure 6:
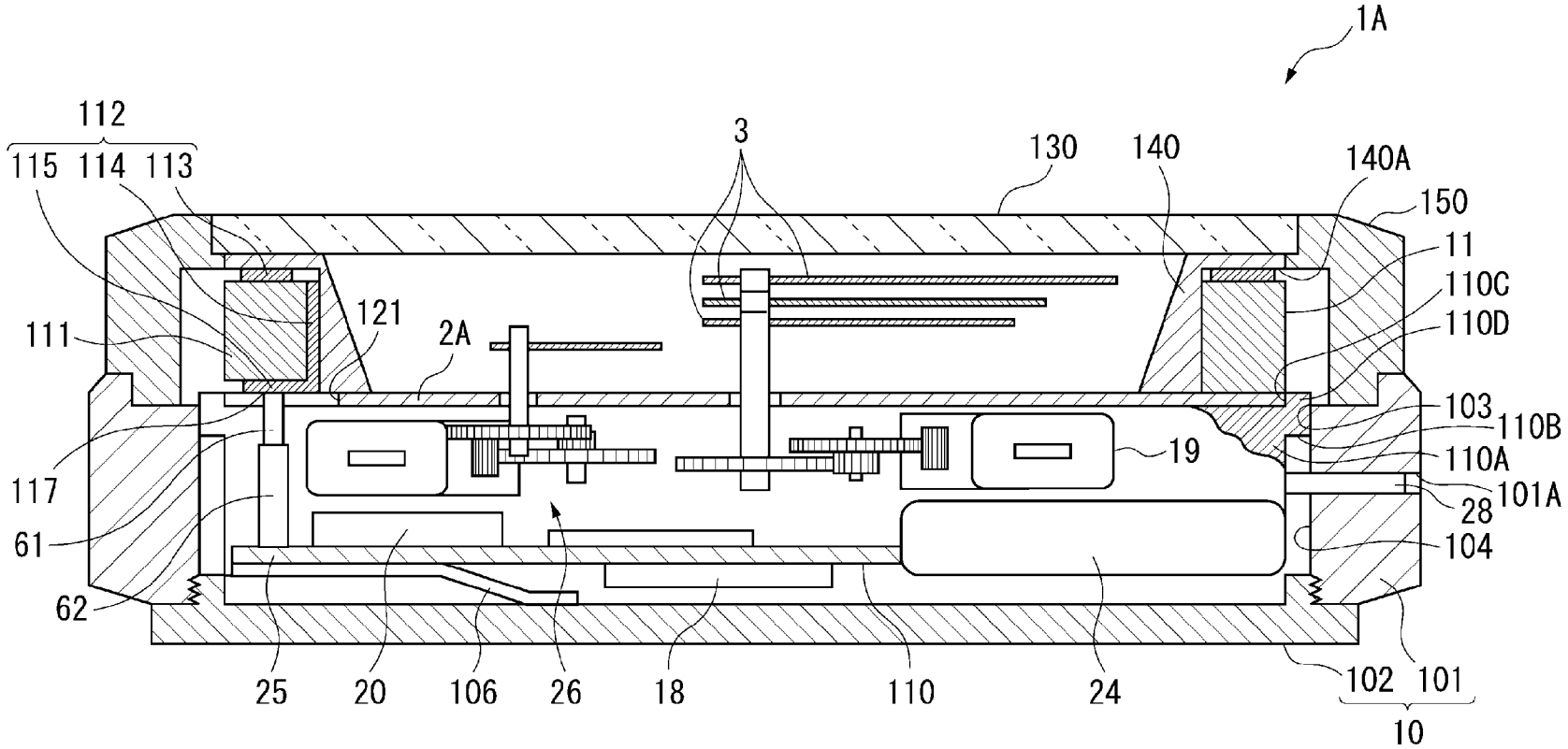
FIG. 6 is a section view of a GPS wristwatch according to a second embodiment of the invention.
Figure 7:
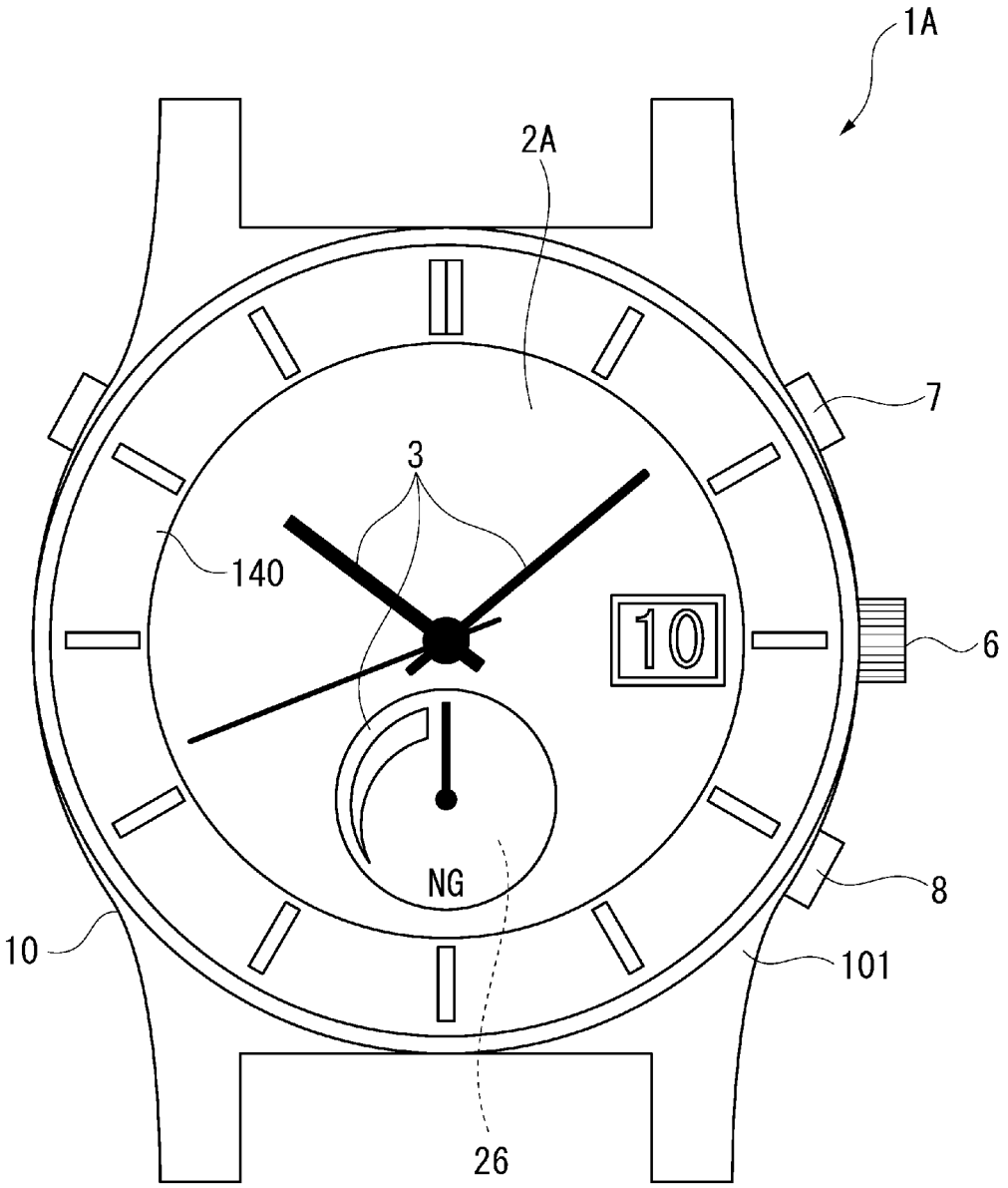
FIG. 7 is a plan view of the GPS wristwatch according to the second embodiment of the invention.
Figure 8:
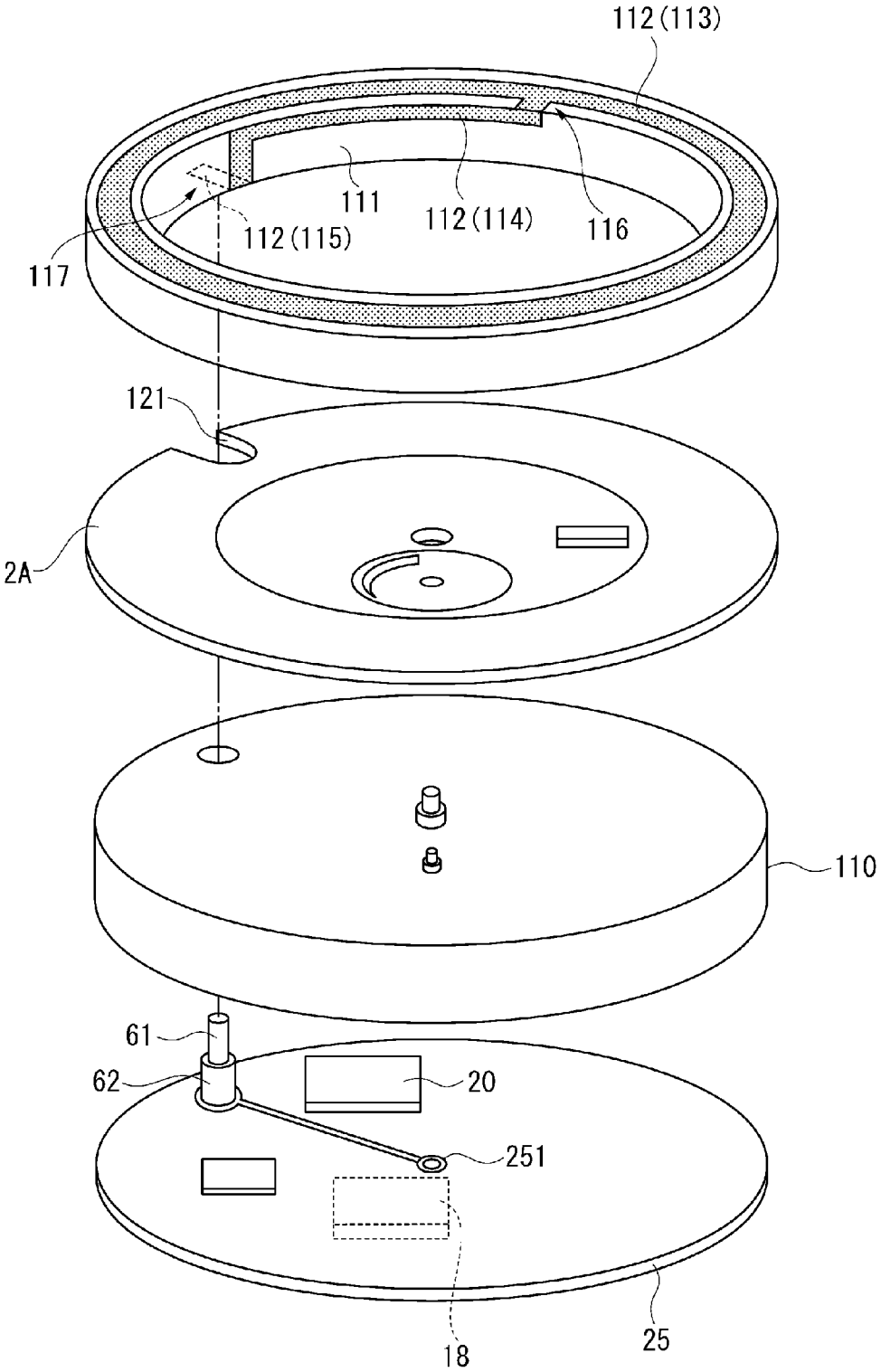
FIG. 8 is an exploded perspective view of the internal construction of the GPS wristwatch according to the second embodiment of the invention.

A GPS wristwatch 1A according to a second embodiment of the invention is described next. FIG. 6 is a schematic section view of the GPS wristwatch 1A. FIG. 7 is a plan view of the GPS wristwatch 1A. FIG. 8 is an exploded perspective view of the internal structure of the GPS wristwatch 1A. Note that like parts in this and the first embodiment described above are identified by like reference numerals, and description thereof is simplified or omitted.

In the first embodiment described above the solar panel support substrate 120 functions as a conductor of the invention, and the solar panel support substrate 120 functions as part of the GPS antenna 11. As shown in FIG. 6 and FIG. 8, a solar panel 120A and solar panel support substrate 120 are not used in this second embodiment and the dial 2A functions as a conductor, that is, as part of the GPS antenna 11.

More specifically, the diameter of the dial 2A is smaller than the inside diameter of the external case 101 in the GPS wristwatch 1A according to the second embodiment of the invention. The dial 2A is made of brass, stainless steel, titanium alloy, or other metal, for example. Note that an appropriate surface treatment such as painting, plating, or sputtering may be applied to the surface of the dial 2A to improve the appearance.

Similarly to the solar panel support substrate 120 in the first embodiment, the outside diameter of the dial 2A and the outside diameter of the GPS antenna 11 are the same, and the GPS antenna 11 is disposed to the face side of the dial 2A. A notch 121 through which the connection pin 61 passes is also disposed in the dial 2A.

A main plate 110A on which parts of the movement 110 are disposed is located inside the external case 101. The main plate 110A is made from plastic or other non-conductive material, and its plane shape is round. A large diameter part 110B with the same or slighter larger diameter than the inside diameter of the external case 101 is disposed on one side of the main plate 110A. A fitting recess 110C in which the dial 2A is fit is also formed in the main plate 110A on the same side as the large diameter part 110B. A spacer 110D that separates the outside edge of the dial 2A and the inside edge of the external case 101 is formed on the outside circumference side of the fitting recess 110C.

The movement 110 including the main plate 110A in which the dial 2A is disposed is press fit inside the external case 101 with the large diameter part 110B of the main plate 110A touching the inside circumference surface of the external case 101.

A power reserve indicator 26 that displays the reserve power stored in the storage battery 24 is disposed to the dial 2A instead of the display 4 of the first embodiment. The power reserve indicator 26 normally displays how much power remains, but switches during signal reception to display the signal reception state in order to prompt the user to find a better reception environment. The hand of the power reserve indicator 26 moves between a position pointing at 6:00 and a position pointing at 12:00, and moves closer to the 12:00 position as the signal reception level rises. The hand pointing at 6:00 means an environment in which reception is not possible.

The GPS antenna 11 in this second embodiment also uses a ring-shaped antenna electrode 112 instead of the C-shaped configuration used in the first embodiment.

More specifically, the antenna wire 113 of the antenna electrode 112 is a ring-shaped part formed on the top surface of the dielectric substrate 111, and receives radio waves entering from the crystal 130 side or radio waves reflected by the back cover 102.

A branch point 116 is formed at one place on the inside circumference side of the antenna wire 113, and the coupling 114 is formed extending from this branch point 116 to the inside circumference surface of the dielectric substrate 111. The coupling 114 is formed circumferentially along the inside circumference surface of the dielectric substrate 111. The end of the coupling 114 on the opposite end as the branch point 116 extends to the bottom surface of the dielectric substrate 111, and the power supply part 115 that continues to the coupling 114 is formed on the bottom surface of the dielectric substrate 111.

The power supply part 115 is formed at a position opposite the notch 121 of the solar panel support substrate 120 at a plane position approximately at the 10:00 marker of the dial 2A, and the distal end part of the connection pin 61 passing through the notch 121 contacts the power supply part 115. This contact renders a power supply point 117 at one point.

The length from the branch point 116 through the coupling 114 to the power supply point 117 is approximately ¼ of the wavelength of the radio waves received by the GPS antenna 11, and is, for example, 1.06 cm when the dielectric constant $\in_r$ of the dielectric substrate 111 is 10.

As shown in FIG. 8, the connection base 62 is connected by a lead to a contact 251 in the center part of the circuit board 25, and the reception unit 18 disposed on the back cover 102 side of the circuit board 25 is connected to this contact 251. Note that the contact 251 is preferably located in the center of the circuit board 25 to enable efficient reception of circularly polarized waves by a 1-wavelength loop antenna such as the GPS antenna 11 in this second embodiment of the invention. However, a problem with locating the contact 251 in the center of the circuit board 25 is that signal loss increases because the wiring is longer. To solve this problem, a low noise amplifier (LNA) can conceivably be disposed to compensate for signal loss between the GPS antenna 11 and the reception unit 18, or more specifically between the GPS antenna 11 and SAW filter 31 (see FIG. 5).

A through-hole 101A through which a charging terminal 28 passes is also formed in the external case 101 as shown in FIG. 6. The charging terminal 28 is connected to a charging control circuit mounted on the circuit board 25 of the movement 110, and power supplied to the charging terminal 28 can be used to charge the storage battery 24.

This second embodiment of the invention has the same effect as the first embodiment. More specifically, the outside diameter of the dial 2A is smaller than the inside diameter of the external case 101 on the plane where the dial 2A is disposed. As a result, the outside edge of the dial 2A is separated from the inside circumference surface of the external case 101, and the dial 2A is disposed without touching the external case 101.

As a result, such problems as the dial 2A touching the external case 101, which is made from a conductive material to improve the appearance, the potential of the dial 2A going to ground, and current not flowing through the dial 2A can be prevented. Current therefore flows reliably through the dial 2A, the dial 2A reliably functions as part of the GPS antenna 11, and antenna performance can be reliably improved.

The dial 2A is also disposed between the GPS antenna 11 and the movement 110 in this GPS wristwatch 1A.

Good antenna performance can therefore be assured because the dial 2A functions as part of the nearby GPS antenna 11. In addition, because the antenna electrode 112 with a ring-shaped antenna wire 113 is formed on a ring-shaped dielectric substrate 111, the signal reception area of the antenna electrode 112 can be increased and the reception sensitivity of the antenna is good.

Furthermore, because the dial 2A must be conductive, it can be made from metal with an excellent appearance. In addition, because the GPS antenna 11 is located around the outside edge of the dial 2A, the display portion of the dial 2A will not be hidden even if the GPS antenna 11 is covered with a dial ring 140. The appearance of the GPS wristwatch 1A can therefore be improved.

Yet further, because the dial 2A for displaying the time also functions as part of the GPS antenna 11, the construction of this GPS wristwatch 1A can be simplified because different functions can be rendered by a single part.

Yet further, a fitting recess 110C for positioning and holding the dial 2A is disposed in the main plate 110A of the movement 110, the outside edge of the main plate 110A can also function as a spacer 110D.

As a result, the dial 2A can be positioned and affixed easily between the movement 110 and the crystal 130. Manufacturability can therefore be improved, the distance between the dial 2A and the external case 101 stabilized, and variation in antenna characteristics can be prevented.

More particularly, the dial 2A that functions as part of the GPS antenna 11 is separated a specific distance from the metal external case 101 and back cover 102. As a result, because the external case 101 and back cover 102 function together as a ground plate (reflector), and the dial 2A that functions as part of the antenna 11 is separated a specific distance from the external case 101 and back cover 102, antenna characteristics can be improved.

Embodiment 3

Figure 9:
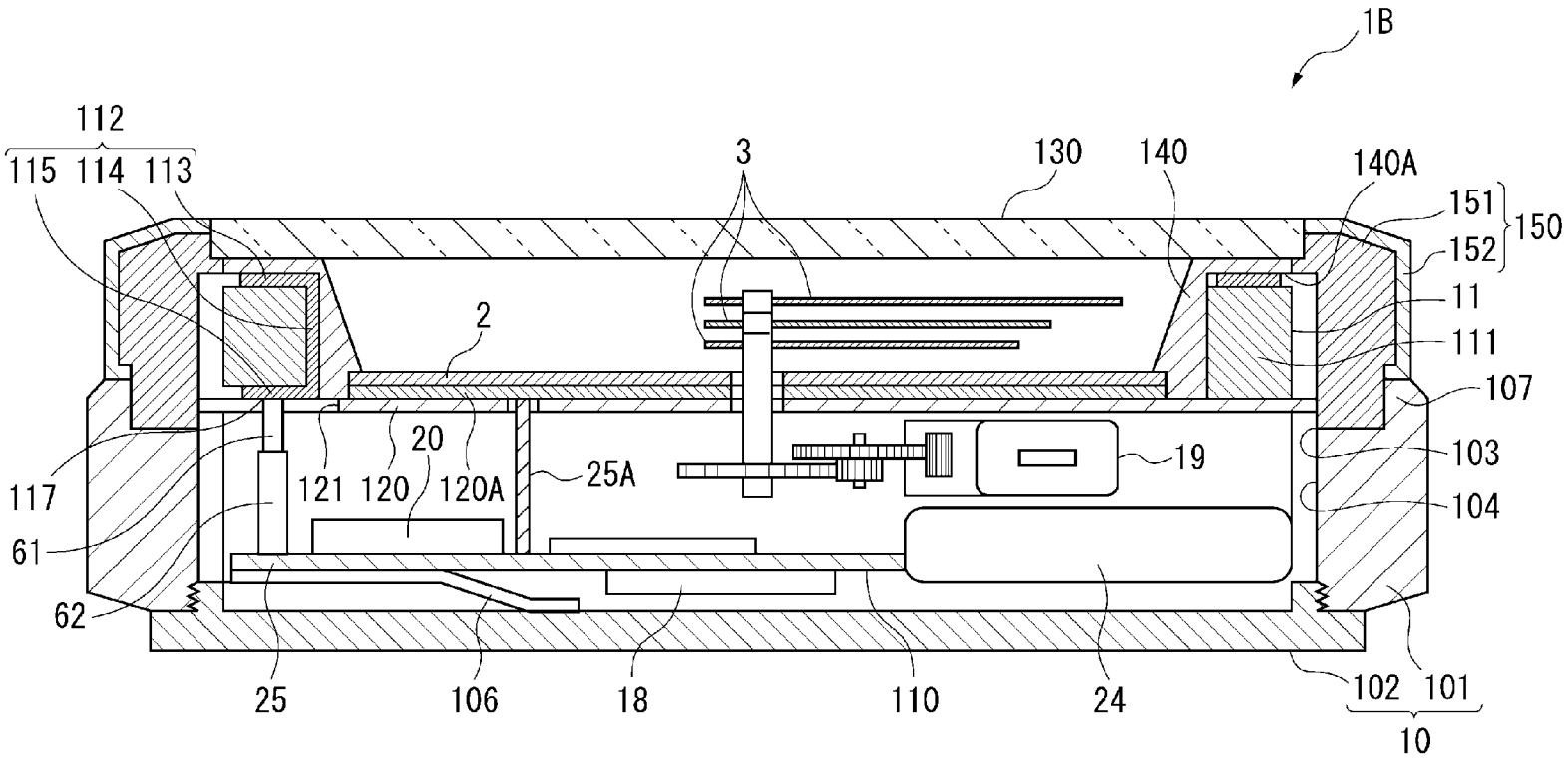
FIG. 9 is a section view of a GPS wristwatch according to a third embodiment of the invention.

A GPS wristwatch 1B according to a second embodiment of the invention is described next. FIG. 9 is a schematic section view of the GPS wristwatch 1B. Note that like parts in this and the first and second embodiments described above are identified by like reference numerals, and description thereof is omitted.

In the GPS wristwatch 1 according to the first embodiment of the invention the outside diameter of the solar panel support substrate 120 is smaller than the inside diameter of the external case 101, and the solar panel support substrate 120 is disposed with its outside edge separated from the inside surface of the external case 101. In this third embodiment of the invention, however, a solar panel support substrate 120 with the same outside diameter as the inside diameter of the bezel 150 is fit into the bezel 150 as shown in FIG. 9.

More specifically, the bezel 150 is formed in a ring with the outside and inside surfaces contiguous to the outside and inside surfaces of the external case 101. The bezel 150 includes an annular bezel body 151 made of plastic or other non-conductive material, and a metal bezel cover 152 that covers the outside surface of the bezel body 151. The inside circumference of the bezel body 151 is the same as the inside circumference of the external case 101, and the inside surface thereof continues flush to the inside surface of the external case 101 with no step therebetween. The bezel cover 152 covers the outside surface of the bezel body 151, and more specifically covers the outside surface from the top edge of the external case 101 to the end face of the crystal 130.

The bezel 150 is press fit into a shoulder 107 formed as a step on the inside edge of the open face 103 side of the external case 101. Note that the bezel 150 may also be affixed with double-sided tape, adhesive, or other means.

The outside diameter of the solar panel support substrate 120 is the same as the inside diameter of the bezel body 151, and the solar panel support substrate 120 is press fit to the inside circumference surface of the bezel body 151.

When the solar panel support substrate 120 is installed to this configuration, the outside edge of the solar panel support substrate 120 is separated by the bezel body 151 from the inside surface of the external case 101 and makes no contact therewith. More specifically, the inside diameter of the external case 101 on the plane where the solar panel support substrate 120 is disposed is the inside diameter of the shoulder 107 of the external case 101. In the thickness direction of the timepiece outside the plane where the solar panel support substrate 120 is disposed, the inside diameter of the external case 101 is the same as or less than the outside diameter of the solar panel support substrate 120, and the external case 101 does not touch the solar panel support substrate 120.

In this third embodiment of the invention, the bezel body 151 thus functions as the spacer of the invention. As a result, this third embodiment has the same effect as the first embodiment and the second embodiment described above. More specifically, because the solar panel support substrate 120 is smaller than the inside diameter of the external case 101 on the plane where the solar panel support substrate 120 is disposed and does not contact the external case 101, the potential does not drop to the ground level of the external case 101. As a result, the same current distribution as in the nearby GPS antenna 11 is produced, the solar panel support substrate 120 functions desirably as part of the GPS antenna 11, and reception characteristics can be improved. More specifically, because the solar panel support substrate 120 that functions as part of the GPS antenna 11 is disposed with a specific distance to the external case 101 and back cover 102 that function as a ground plate, antenna characteristics can be improved.

In addition, the bezel body 151 that functions as a spacer also functions as a spacer for fitting and positioning the solar panel support substrate 120.

The bezel body 151 therefore also functions to position the solar panel support substrate 120, enabling simplifying the construction. The distance between the solar panel support substrate 120 and external case 101 is also stable, variation in antenna characteristics can be prevented, and stable characteristics can be provided.

The appearance of the GPS wristwatch 1B can also be improved because a metal bezel cover 152 with a high quality feel is provided on the outside surface of the bezel body 151. Note that a configuration not using the bezel cover 152 is also conceivable by rendering the bezel body 151 from a ceramic to maintain the quality of appearance while also improving strength. With this configuration, radio waves are not blocked by a metal bezel cover 152, and reception performance can be improved over a configuration using a metal bezel cover 152.

Embodiment 4

Figure 10:
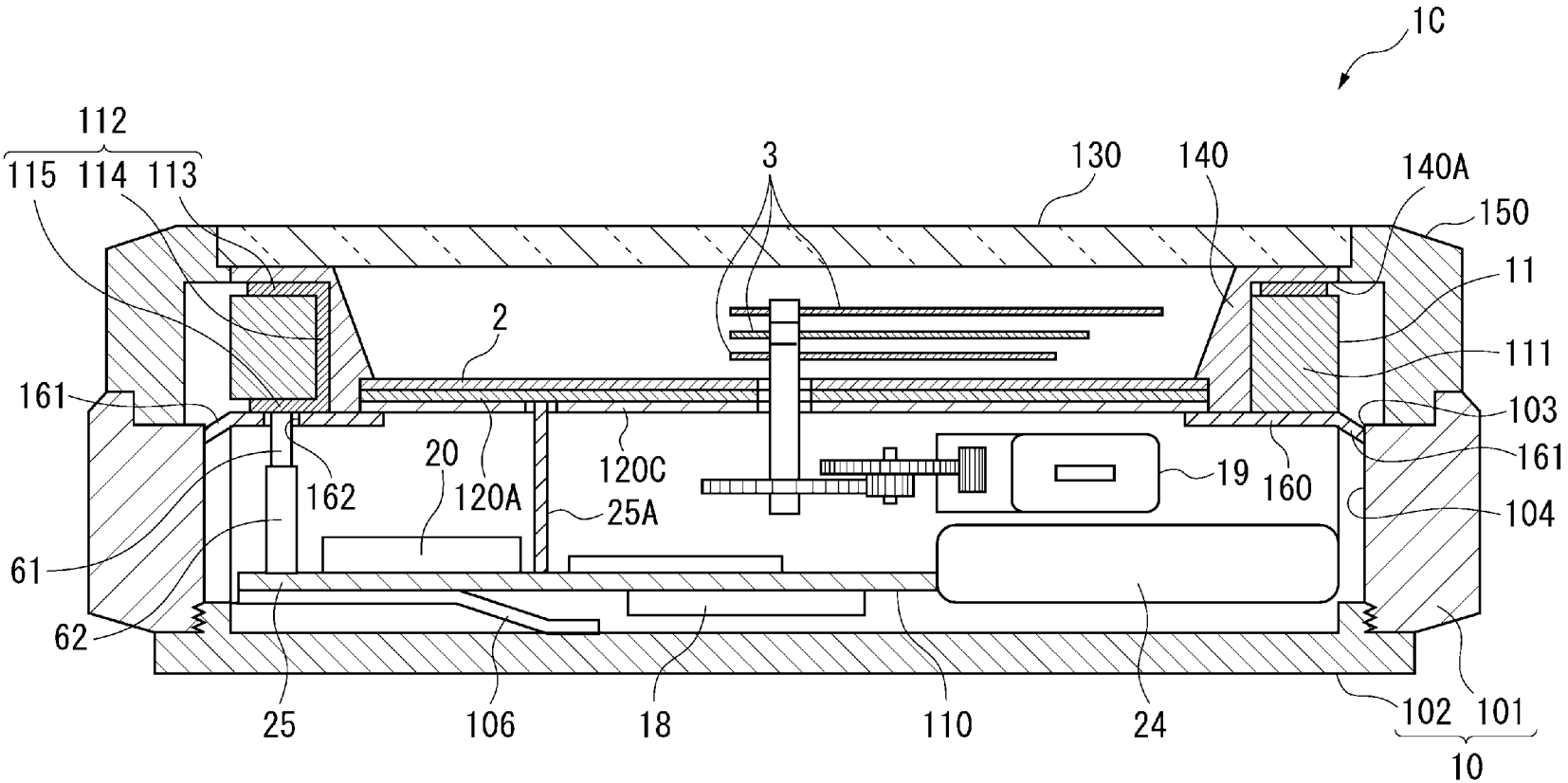
FIG. 10 is a section view of a GPS wristwatch according to a fourth embodiment of the invention.
Figure 11:
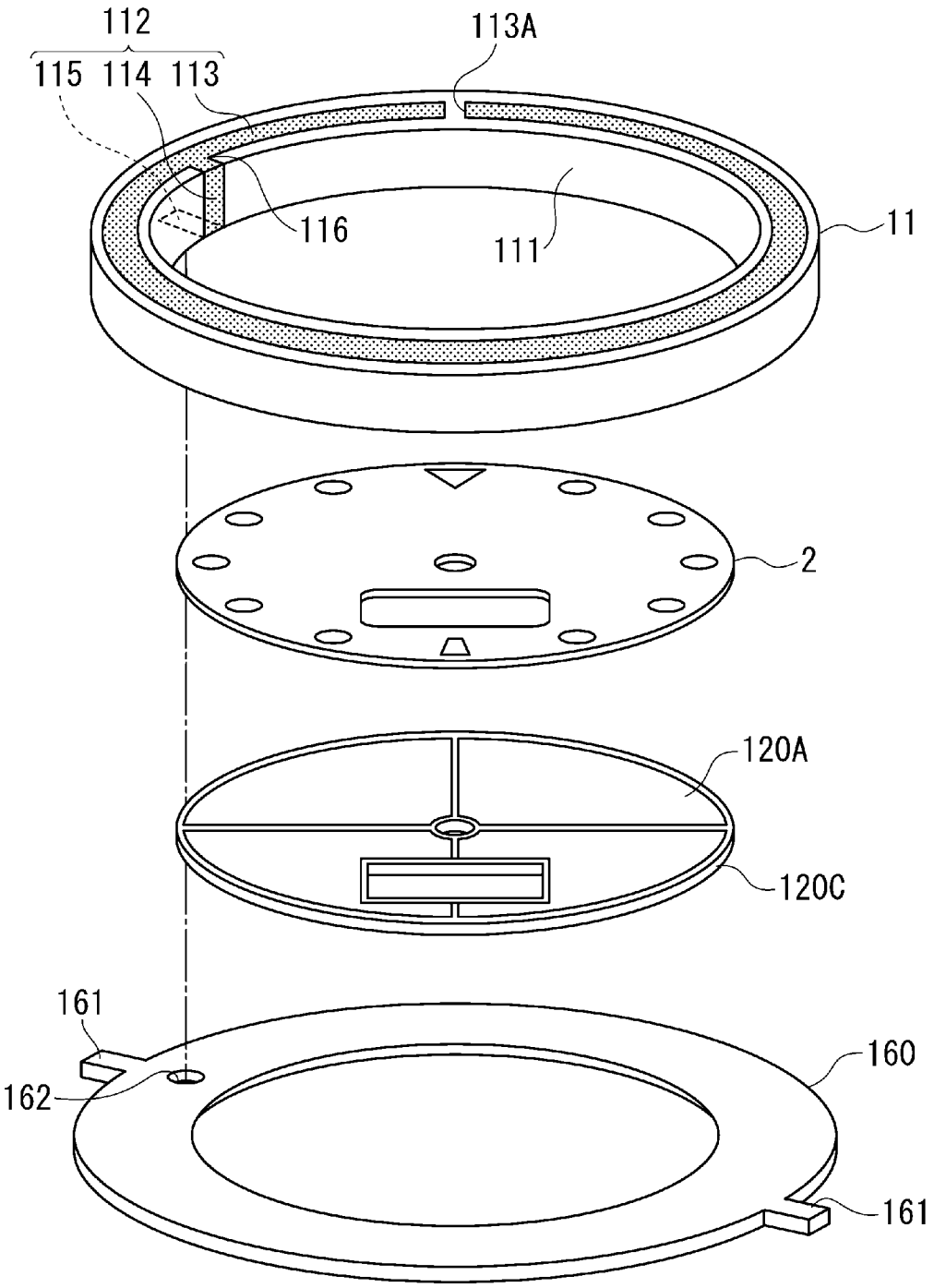
FIG. 11 is an exploded perspective view of the internal construction of the GPS wristwatch according to the fourth embodiment of the invention.

A GPS wristwatch 1C according to a fourth embodiment of the invention is described next. FIG. 10 is a schematic section view of the GPS wristwatch 1C. FIG. 11 is an exploded perspective view of the internal structure of the GPS wristwatch 1C. Note that like parts in this and the embodiments described above are identified by like reference numerals, and description thereof is simplified or omitted.

In the GPS wristwatch 1 according to the first embodiment of the invention the outside diameter of the solar panel support substrate 120 is smaller than the inside diameter of the external case 101, and the solar panel support substrate 120 is disposed with its outside edge separated from the inside surface of the external case 101. In this fourth embodiment of the invention, however, an annular ring conductor 160 is disposed around the outside of the solar panel support substrate 120C as shown in FIG. 10 and FIG. 11. The ring conductor 160 also has two contact tabs 161 and only the contact tabs 161 contact the external case 101, that is, the ring conductor 160 is disposed in contact with the external case 101 at two places.

More specifically, in the GPS wristwatch 1C according to the fourth embodiment of the invention, the dial 2 made from plastic or other non-magnetic material, the solar panel 120A, and the solar panel support substrate 120C have an outside diameter that is smaller than the inside diameter of the GPS antenna 11, and are disposed stacked in order on the inside circumference side of the GPS antenna 11. Note that as in the first embodiment the solar panel support substrate 120C is a metal (conductive) member.

The ring conductor 160 is made by stamping a metal sheet of stainless steel, for example, into a ring.

A pair of contact tabs 161 protrude to the outside from the outside edge of the ring conductor 160. These contact tabs 161 (protrusions) are disposed point symmetrically to the plane center of the ring conductor 160. More specifically, the contact tabs 161 are formed 180 degrees apart on the outside edge of the ring conductor 160.

When assembled into the external case 101, the distal ends of the contact tabs 161 contact the inside surface of the external case 101. More specifically, the distance between the distal ends of the contact tabs 161 is slightly greater than the inside diameter of the external case 101. As a result, the contact tabs 161 are shaped like flat springs, elastically deform when pressed into the external case 101 due to their spring characteristic, and the distal ends contact the inside surface of the external case 101.

The outside diameter of the outside edge of the ring conductor 160 where the contact tabs 161 are not disposed is smaller than the inside diameter of the external case 101.

Note that the contact tabs 161 are not limited to being formed in unison with the ring conductor 160, and a configuration having separate contact tables attached to the back of the ring conductor 160, for example, is also conceivable. The shape of the contact tabs 161 is also not limited to a plane rectangular shape as shown in FIG. 11, and may be substantially triangular in plan view, rounded into a circular shape at the distal ends, or any other shape enabling point contact with the inside surface of the external case 101.

A through-hole 162 through which the distal end of the connection pin 61 passes to touch the power supply part 115 is also provided in the ring conductor 160.

In addition to having the same effect as the embodiments described above, the configuration of this fourth embodiment renders the conductor from two parts, the solar panel support substrate 120C and the ring conductor 160, by disposing the annular ring conductor 160 around the solar panel support substrate 120C in contact with the solar panel support substrate 120C. The solar panel support substrate 120C can therefore be the same size as the solar panel 120A, and the solar panel support substrate for a common timepiece can be used because there is no need to use an oversized solar panel support substrate 120. As a result, parts for a solar-powered timepiece that does not have an antenna 11 can used for the solar panel support substrate 120C, and cost can be reduced accordingly.

A conductor of the same size as the solar panel support substrate 120 of the first embodiment can also be rendered by the solar panel support substrate 120C and ring conductor 160, and GPS antenna 11 characteristics can be improved as in the first embodiment.

In addition, contact tabs 161 are formed on the ring conductor 160, and the ring conductor 160 is disposed in contact with the inside surface of the external case 101 at only two points. If the ring conductor 160 thus contacts the external case 101 at only two points, current flow through the ring conductor 160 is greater when there is contact at three points because the distance between the points of contact is greater, and the potential drop in the ring conductor 160 is less. As a result, there is less deterioration in antenna characteristics, and better antenna characteristics can be achieved than when a ring conductor 160 is not used.

In addition, because the contact tabs 161 of the ring conductor 160 contact the inside surface of the external case 101, the ring conductor 160 can be positioned more easily when it is installed, and GPS wristwatch 1C production efficiency can be improved. Yet further, because the ring conductor 160 that is part of the GPS antenna 11 contacts the external case 101, GPS antenna 11 potential is stable, and electrostatic resistance is greater than when the antenna 11 is separated from the external case 101.

Note that the conductor and the external case 101 contacting at only two points can be achieved in terms of electrostatic characteristics by the conductor and the external case 101 touching at two places. This means that, for example, providing another contact tab near one of the contact tabs 161 of the ring conductor 160 so that the conductor and external case touch at three places is effectively the same as the conductor and external case 101 contacting at only two points because those two tabs effectively function as a single point in terms of electrostatic characteristics because the gap between the two tabs is narrow.

Embodiment 5

Figure 12:
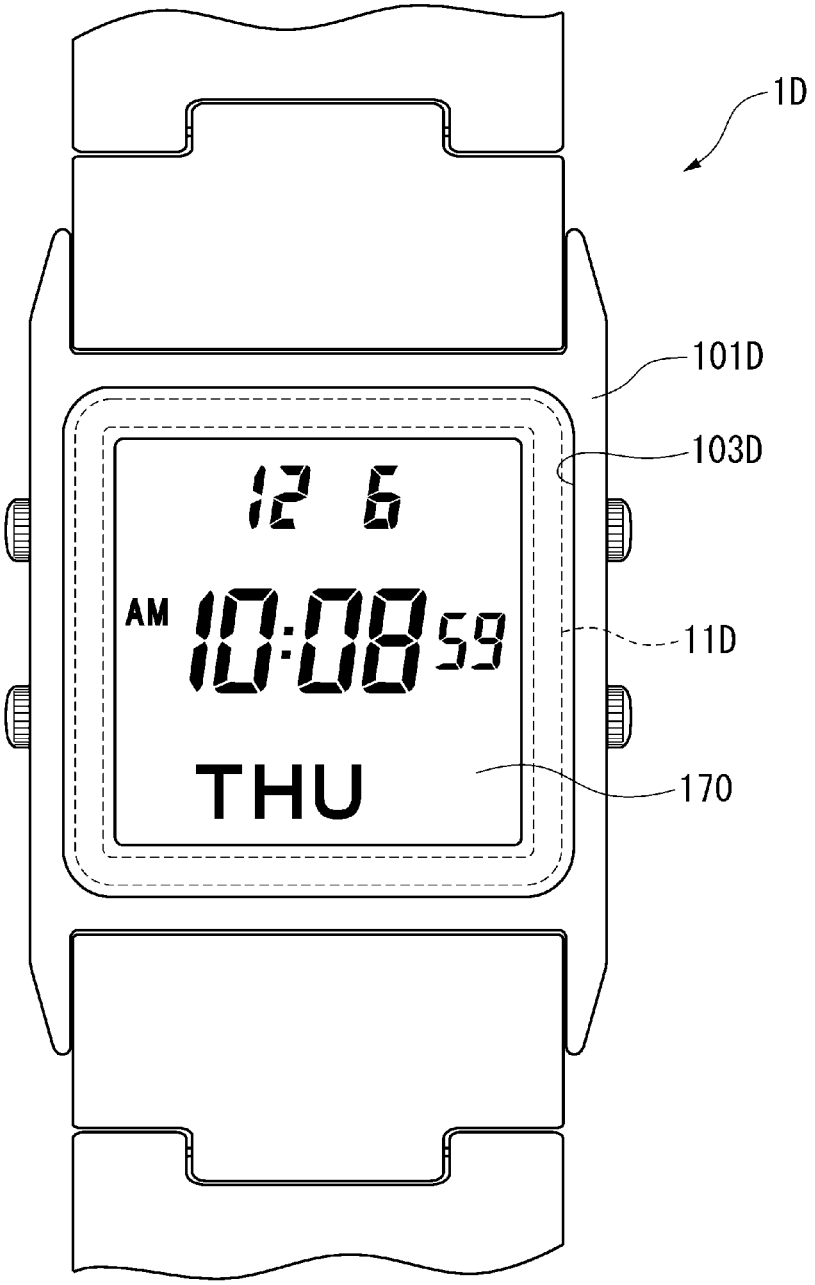
FIG. 12 is a plan view of a GPS wristwatch according to a fifth embodiment of the invention.
Figure 13:
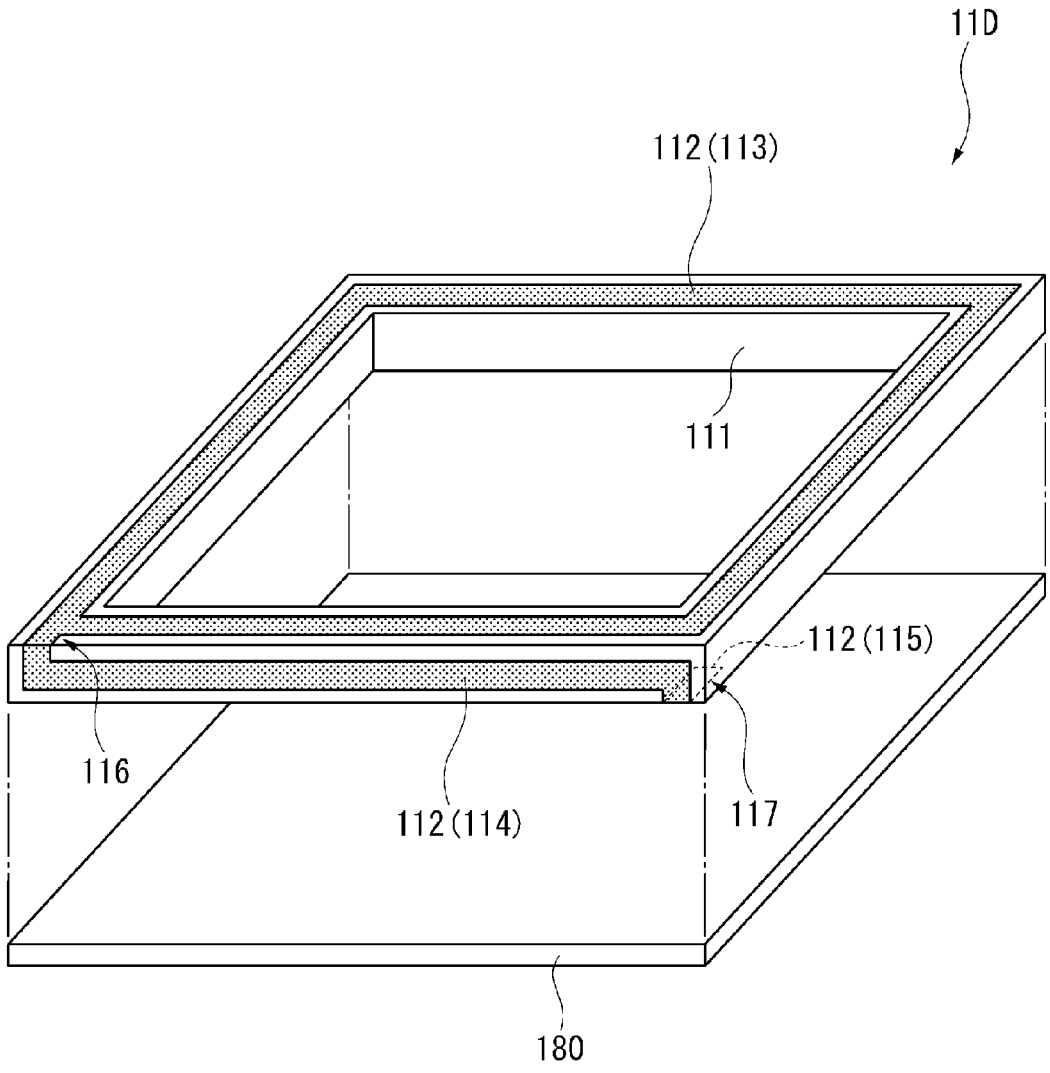
FIG. 13 is a perspective view of an example of a GPS antenna in the fifth embodiment of the invention.

A GPS wristwatch 1D according to a fifth embodiment of the invention is described next. FIG. 12 is a plan view of the GPS wristwatch 1D. FIG. 13 is an exploded perspective view of the internal structure of the GPS wristwatch 1D. Note that like parts in this and the embodiments described above are identified by like reference numerals, and description thereof is simplified or omitted.

In the first embodiment described above the external case 101 is round in plan view and the time is displayed by hands 3. This fifth embodiment as shown in FIG. 12 and FIG. 13 uses an external case 101D that is rectangular in plan view, and displays the time using an LCD panel 170.

More specifically, the external case 101D is a rectangular cylinder made of a conductive metal material with a quadrangular open face 103D. A crystal 130D (not shown in the drawing) is fit into this open face 103D, and an antenna 11D and LCD panel 170 are disposed behind the crystal 130D.

As shown in FIG. 13, the antenna 11D is shaped like a rectangular frame. An antenna for receiving circularly polarized waves such as GPS satellite signals can also be achieved with a square configuration instead of a plane circle as described in the foregoing embodiments.

The antenna 11D includes a dielectric substrate 111 with a rectangular frame shape, and an antenna electrode 112. The antenna electrode 112 includes a antenna wire 113 disposed continuously on the surface of the dielectric substrate 111, a coupling 114 that connects to the antenna wire 113 at a branch point 116, and a power supply part 115 that is connected to the other end of the coupling 114, and a connection pin not shown contacts the power supply part 115 at the power supply point 117.

The antenna 11D is disposed around the LCD panel 170. The crystal 130D covers the LCD panel 170 and the surface of the antenna 11D. The inside surface (back side) of the crystal 130D is printed with a non-conductive ink so that the antenna 11D cannot be seen through the crystal 130D.

As shown in FIG. 13, a substantially square conductor 180 conforming to the outside shape of the antenna 11D is disposed between the antenna 11D and the movement (module) disposed on the back cover side of the antenna 11D.

The conductor 180 is formed to a size that is greater than or equal to the size of the antenna 11D, and enables placement inside the external case 101D. More specifically, if the plane shape of the inside surface of the external case 101D is square, the length of one side is greater than the length of one side of the conductor 180.

The conductor 180 is disposed so that it does not contact the inside surface of the external case 101D, or so that it contacts the inside surface of the external case 101D at one or only two points. If there is contact at one or two points, contact tabs may be formed protruding from the conductor 180 so that the tab contacts the inside of the external case 101D.

The configuration of this fifth embodiment has the same operating effect as the embodiments described above. More specifically, problems such as current not flowing through the conductor 180 because the conductor 180 contacts the conductive external case 101D and the potential of the conductor 180 drops to ground can be prevented, and a drop in antenna performance can be prevented.

Other Embodiments

The invention is not limited to the foregoing embodiments and can be varied in many ways without departing from the scope of the accompanying claims.

For example, the GPS wristwatch 1 is described as a hybrid timepiece having hands 3 and a display 4, but the invention is not so limited and can be applied to a digital timepiece having only a display as described in GPS wristwatch 1D above. The invention is also not limited to wristwatches, and can be applied to pocket watches and other types of timepieces, and other types of devices having an electronic timepiece function, including cell phones, digital cameras, and various mobile information terminals.

Furthermore, the foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The invention is also not limited to receiving satellite signals from positioning information satellites, and can also be applied to near-field wireless receiving devices such as RFID tags that operate in the 900 MHz band.

The invention is also not limited to receiving circularly polarized waves, and can also be used to receive linear polarized waves.

A dial ring 140 is disposed as a ring member covering the GPS antenna 11 in the embodiments described above, but the invention is not so limited. The ring member may be a member without markers, and may be shaped with the inside face perpendicular to the dial 2 instead of tapered or otherwise shaped. The ring member is also not essential to the invention, and if the inside of the bezel 150 extends to the inside so that it covers the GPS antenna 11, a separate ring member can be omitted.

The first to fourth embodiments described above are configured so that the GPS antenna 11 cannot be seen from the outside by covering the GPS antenna 11 with the dial ring 140, but the invention is not so limited. For example, as in the fifth embodiment, the inside of the crystal 130 that covers the GPS antenna 11 could be printed on so that the GPS antenna 11 cannot be seen from the outside. In this case the printer ink is a non-conductive ink that will not affect the reception characteristics of the GPS antenna 11.

Note, further, that the bezel 150 of embodiments 1, 2 and 4 shown in FIG. 2, FIG. 6, and FIG. 10 may be metal. If a metal bezel 150 is used, antenna performance drops compared with using a ceramic bezel, but processing is easier and the cost can be reduced.

In embodiments 1 to 3 and 5, the solar panel support substrate 120 and dial 2A used as a conductor are disposed separated from the inside surface of the external case 101, but the invention is not limited to configurations that prevent contact therebetween.

For example, as in the fourth embodiment, protrusions that project from the outside edge could be provided or positioning the solar panel support substrate 120 or dial 2A, and these protrusions could contact the inside of the external case 101 at a total of one or two points. These protrusions preferably have a spring characteristic to reliably contact the inside of the case.

Even if the conductor thus contacts the external case, the number of contact locations (area) is small, and if the potential of the conductor does not drop to ground, the same current distribution as in the proximal GPS antenna 11 will be induced in the conductor. The conductor therefore functions as part of the GPS antenna 11.

An embodiment in which the metal dial 2A, and an embodiment in which the solar panel support substrate 120, also function as the conductor are described above, but a configuration that has a dedicated conductor, such as a metal plate, that cannot also be used as another functional member disposed between the movement 110 and the crystal 130 is also conceivable.

Note that the conductor material is not limited to a metal member, and a conductor having a metal film formed on the surface of a panel made from a non-metallic material is also conceivable. The conductor is also not limited to uninterrupted panel configurations, and members having a plurality of small pieces formed in a continuous plate, or a metal mesh member that is substantially flat, are also conceivable.

The outside diameter of the dial 2A and solar panel support substrate 120 are the same as the outside diameter of the GPS antenna 11 above, but the invention is not so limited. More specifically, they may be smaller than the inside diameter of the GPS antenna 11. Note that because current tends to flow more efficiently as the diameter increases, the diameter is preferably as large as possible, and more specifically is greater than or equal to the diameter of the antenna wire 113 of the antenna electrode 112.

Figure 14:
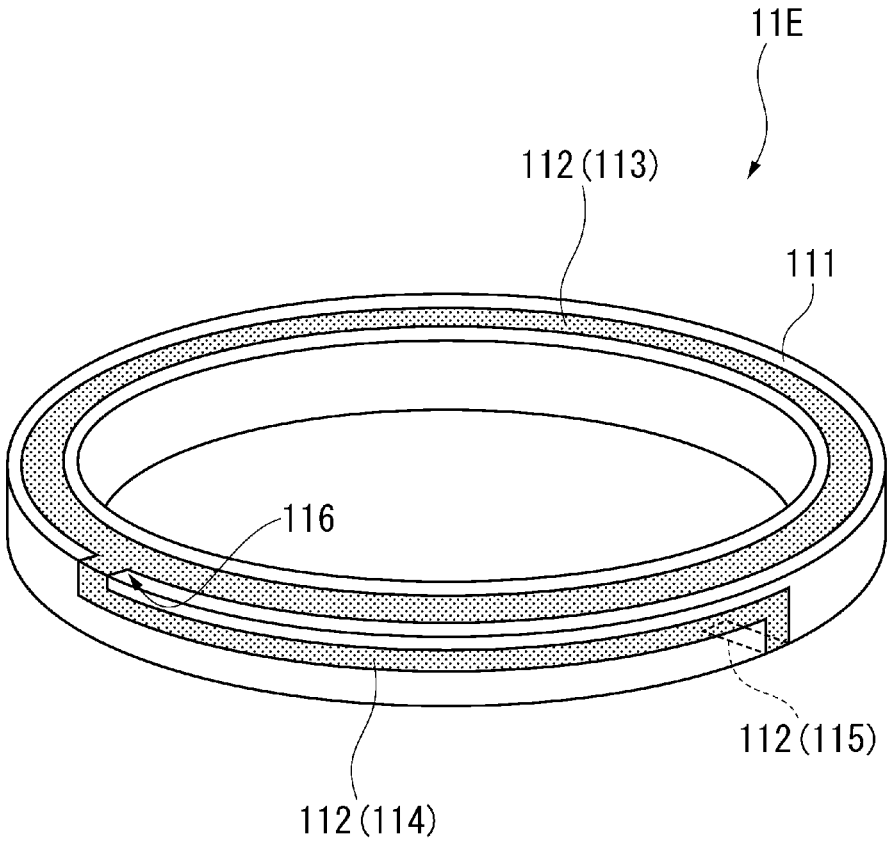
FIG. 14 is a perspective view of another example of a GPS antenna.

Yet further, a configuration in which the coupling 114 is formed along the inside circumference surface of the dielectric substrate 111 from the branch point 116 of the antenna wire 113 is described as the GPS antenna 11 above, but the invention is not so limited. For example, as shown in GPS antenna 11E in FIG. 14, a configuration having the branch point 116 on the outside circumference side of the antenna wire 113, and the coupling 114 extending from this branch point 116 to the outside circumference surface of the dielectric substrate 111 and then circumferentially along the outside surface is also conceivable.

Figure 15:
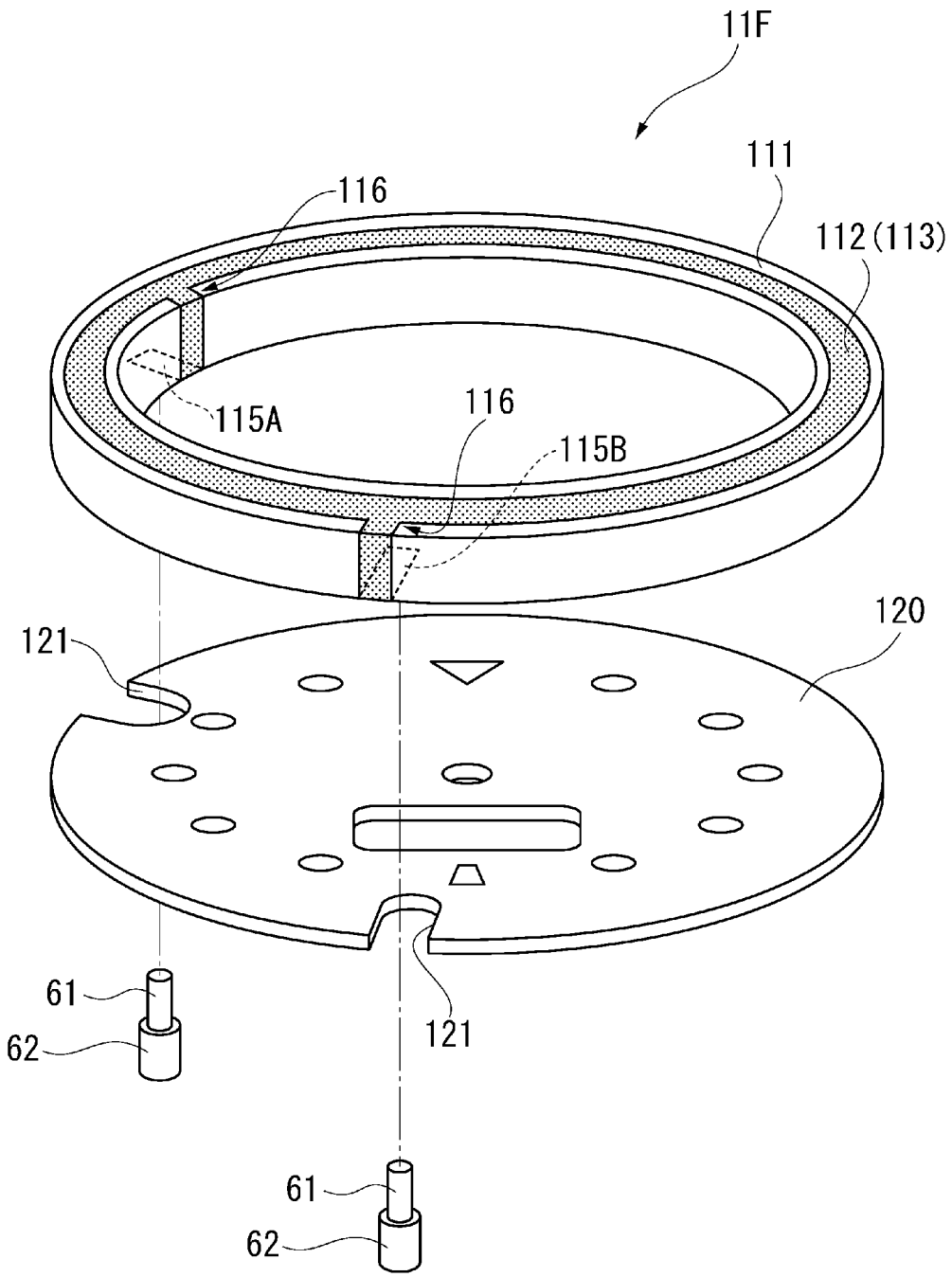
FIG. 15 is a perspective view of another example of a GPS antenna.

A dielectric substrate 111 having a single power supply part 115 is described above, but a GPS antenna 11F having a plurality of power supply parts 115 as shown in FIG. 15 is also conceivable. The GPS antenna 11F shown in FIG. 15 has two power supply parts 115A and 115B disposed to a ring-shaped antenna wire 113. These power supply parts 115A and 115B are two orthogonal power supplies, that is, the two power supply parts 115A and 115B are preferably disposed to positions having a phase difference of 90 degrees. In this case there are also two connection pins 61 corresponding to the two power supply parts 115A and 115B of the GPS antenna 11, and satellite signals are passed from these two connection pins 61 to the circuit board 25. The circuit board 25 executes a circularly polarized wave reception process by adjusting the phase of these two paths and passing signals to the reception unit 18.

The back cover 102 is made from a conductive material and also functions as a reflector, but a configuration in which the back cover 102 is made from plastic, ceramic, or other non-conductive material and does not function as a reflector is also conceivable.

A connection pin 61 is described as a connection member that contacts the power supply part 115, but the invention is not limited to such pin-like members. For example, the connection member could be a flat plate such as a flat spring, in which case the urging force of the flat spring causes the connection plate to contact the power supply point 117 with a specific contact pressure.

A configuration having a charging terminal 28 for externally supplying power is described in the second embodiment described above, but configurations that use the solar panel 120A of the first embodiment, or use both the charging terminal 28 and solar panel 120A, are also conceivable.

Other Embodiments

The relationship between the size of the conductor of the invention and the external case was studied as described below.

Note that the invention is not limited to the embodiments described below.

Conductor Size

Figure 16:
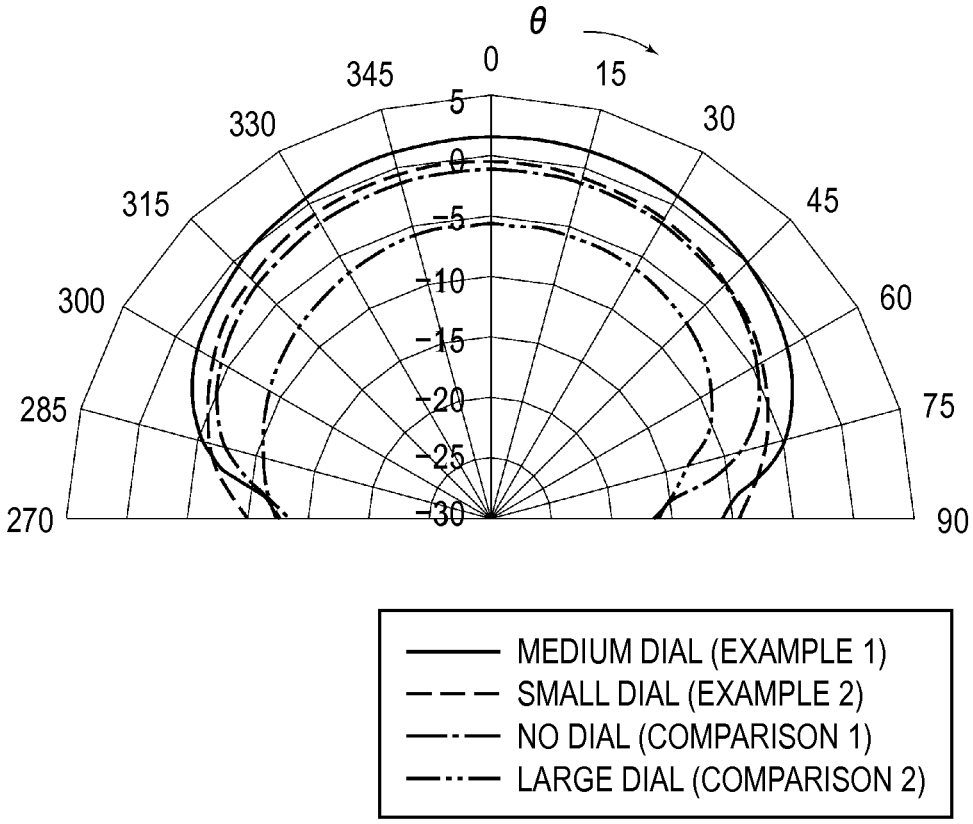
FIG. 16 shows the results of simulating the radiation pattern of a GPS antenna, and shows the relationship between the size of the dial and the antenna gain.

In a configuration that uses the dial 2A described in the second embodiment as a conductor, antenna gain was measured and the radiation patterns were compared using dials 2A of different sizes. FIG. 16 is a graph showing the simulated results of the GPS antenna radiation patterns.

The GPS antenna 11 had an outside diameter of 38 mm and was 2 mm thick.

The outside diameter of the dial 2A (conductor) and the outside diameter of the GPS antenna 11 were the same in the first example using a "medium dial." The outside diameter of the dial 2A (conductor) was 1 mm less than the radius of the GPS antenna 11 in the second example using a "small dial."

A first comparison was a blank that did not use a dial 2A. The second comparison used a "large dial", that is, the outside diameter of the dial 2A was the same as the inside diameter of the external case 101, the dial 2A was fit in the inside circumference of the external case 101, and the entire perimeter of the dial 2A was in contact with the external case 101. The results are shown in FIG. 16.

In FIG. 16 the zenith on the crystal 130 side of the GPS antenna 11 is the Z-axis, and the inclination to the Z-axis is angle θ. Note that angle θ on the back cover 102 side of the GPS antenna 11 is 180°.

As will be known from the results shown in FIG. 16, antenna gain is better with the examples 1 and 2 that use a dial 2A than comparison 1 that does not use the dial 2A. A larger diameter dial 2A was also shown to improve antenna gain in examples 1 and 2. Note, further, that antenna gain was also lower in comparison 2, which used an even larger diameter dial 2A with the entire circumference of the dial 2A in contact with the conductive external case 101, than in comparison 1 that did not have a dial 2A.

Relationship Between Conductor and External Case

Figure 17:
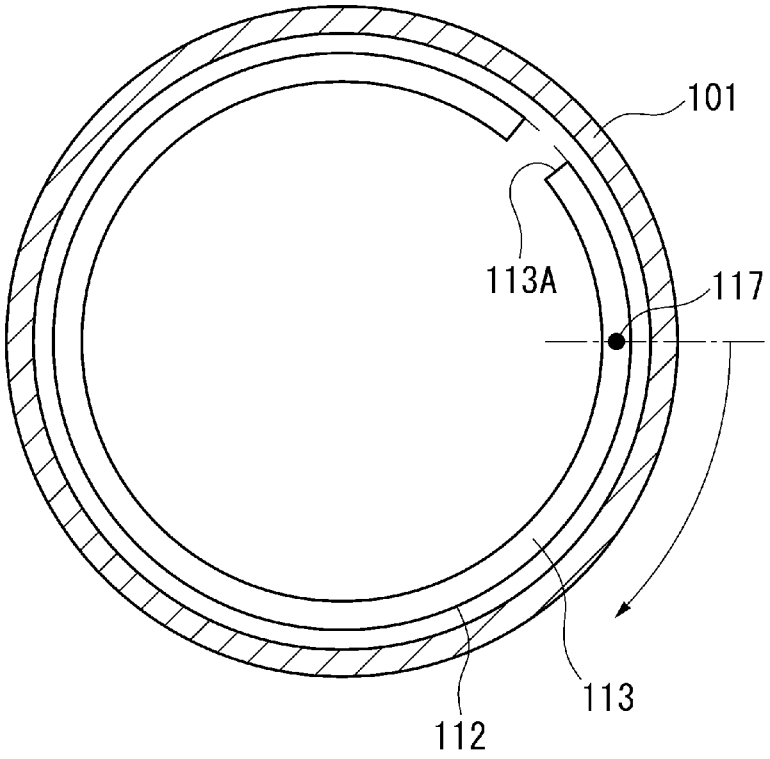
FIG. 17 describes the concept of a study of the relationship between antenna gain and contact between the dial and external case.
Figure 18:
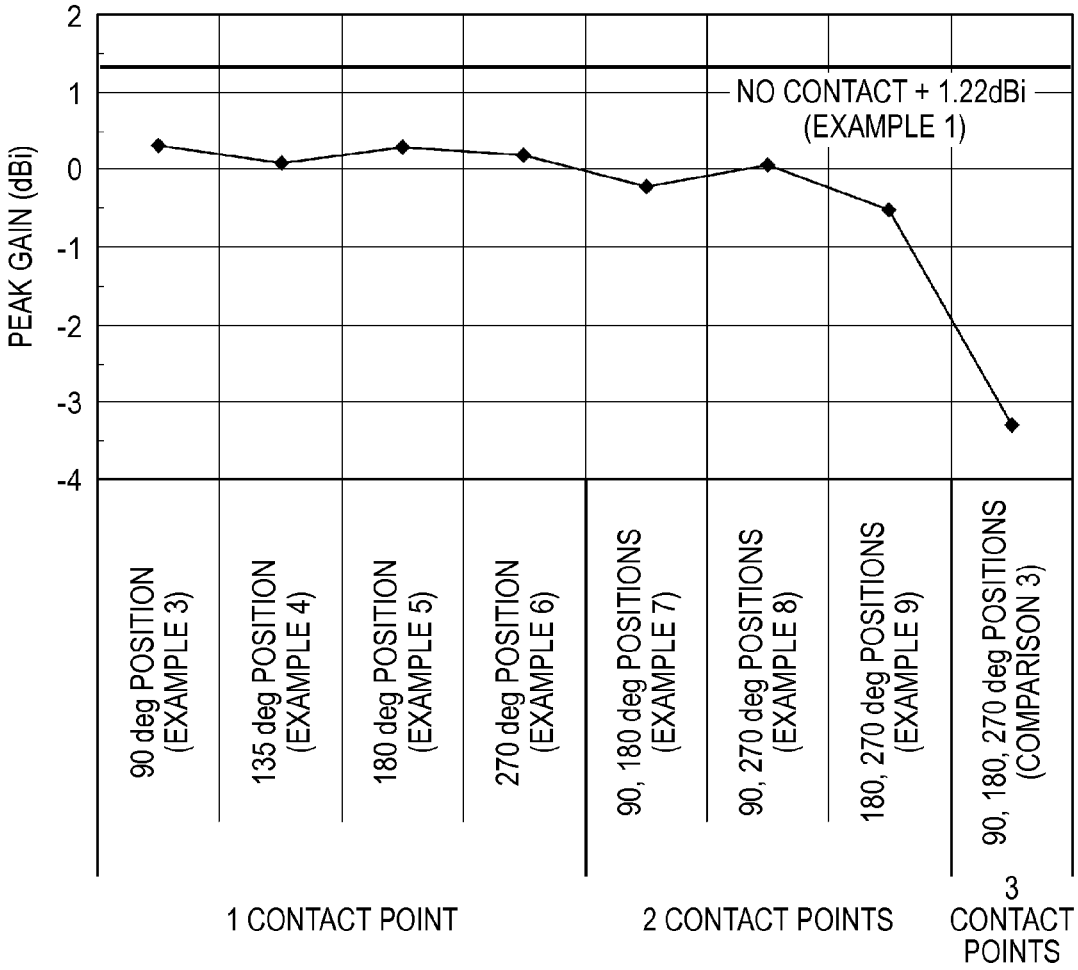
FIG. 18 is a graph showing the relationship between peak gain and contact between the dial and external case.

The relationship between antenna gain and contact between the dial and external case was also studied. FIG. 17 describes contact between the dial and the external case during the study. FIG. 18 shows the relationship between peak gain and contact between the dial and the external case.

The GPS antenna 11 used a C-shaped antenna electrode 112, had an outside diameter of 38 mm, and was 2 mm thick. As shown in FIG. 17, the location of the power supply point 117 of the GPS antenna 11 was at 0 degrees, and the opening 113A was at 315 degrees.

The outside diameter of the dial 2A was the same as the outside diameter of the GPS antenna 11. The dial 2A also had a tab (not shown in FIG. 17) protruding from the outside edge at a specific central angle from the power supply point 117 around the circumference as indicated by the arrow in FIG. 17. The dial 2A was disposed inside the external case 101, and peak antenna gain was compared.

Example 3 used a dial 2A with one tab protruding at a position 90 degrees from the power supply point 117, contacting the external case 101 at one point.

Example 4 used a dial 2A with one tab protruding at a position 135 degrees from the power supply point 117, contacting the external case 101 at one point.

Example 5 used a dial 2A with one tab protruding at a position 180 degrees from the power supply point 117, contacting the external case 101 at one point.

Example 6 used a dial 2A with one tab protruding at a position 270 degrees from the power supply point 117, contacting the external case 101 at one point.

Example 7 used a dial 2A with two tabs protruding at positions 90 degrees and 180 degrees from the power supply point 117, contacting the external case 101 at two points.

Example 8 used a dial 2A with two tabs protruding at positions 90 degrees and 270 degrees from the power supply point 117, contacting the external case 101 at two points.

Example 9 used a dial 2A with two tabs protruding at positions 180 degrees and 270 degrees from the power supply point 117, contacting the external case 101 at two points.

Comparison 3 used a dial 2A with three tabs protruding at positions 90 degrees, 180 degrees, and 270 degrees from the power supply point 117, contacting the external case 101 at three points.

The results are shown in FIG. 18. Note that the peak gain of example 1 in which there are no protruding tabs and no contact with the external case 101 is also shown for reference.

It will be known from the results in FIG. 18 that peak gain drops as a result of the dial 2A contacting the external case 101. Peak gain was also shown to decrease as the number of contact points increases. However, while there is not a particular difference in peak gain between examples 3 to 6 having contact at one point and examples 7 to 9 having contact at two points, a sharp drop in peak gain was confirmed in comparison 3 having contact at three points. This shows that the current distribution in the dial 2A can be maintained to a degree when there is contact at up to two points, and antenna characteristics can be improved.

In addition, in examples 3 to 6 having one contact point, the position at 135 degrees (example 4) from the power supply point 117 located diametrically from the opening 113A is farthest from the opening 113A when compared with positions at 90 degrees (example 3), 180 degrees (example 5), and 270 degrees (example 6), and peak gain tended to drop.

Yet further, in examples 7 to 9 having two contact points, the positions at 90 degrees and 270 degrees (example 8) from the power supply point 117 where the contact positions are diametrically opposite (point symmetrical) afforded better peak gain than positions at 90 degrees and 180 degrees from the power supply point 117 (example 7) and positions at 180 degrees and 270 degrees (example 9) where the contact positions are not diametrically opposite.

As described above, because the dial 2A (solar panel support substrate 120) also functions as part of the GPS antenna 11 and the current is the same as in the antenna electrode 112, a type of slot antenna is formed by the gap to the external case 101. In other words, the timepiece structure according to the invention can be said to function as both a loop antenna and a slot antenna. Therefore, even when protrusions must be disposed to the dial 2A and connected to the external case 101 for structural reasons as described above, the protrusions are preferably separated as much as possible from the opening 113A to avoid affecting the current distribution of the dial 2A, and when there is contact at two points, contact at symmetrical positions is preferable because a drop in antenna characteristics can be suppressed.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application Nos. 2011-000406, filed Jan. 5, 2011 and 2011-179824, filed Aug. 19, 2011 are expressly incorporated by reference herein.

What is claimed is:

1. A timepiece with a wireless function, comprising:

a substantially annular antenna configured to receive satellite signal transmissions having a predefined first wavelength, said antenna having a conductive antenna electrode and a dielectric substrate, said dielectric substrate being configured to shorten the wavelength of satellite signal transmissions that pass through it to define shortened satellite signals having a second wavelength shorter than the first wavelength, the antenna electrode having an antenna wire configured to receive the shortened satellite signals;

a movement that displays time and has a reception unit configured to process the received shorten satellite signals;

a conductive case that houses the movement and is electrically connected to a ground terminal of the reception unit;

a crystal that is disposed on the face side of the case and covers the face side of the movement, said antenna wire being disposed between the movement and the crystal in a lateral view; and a conductive conductor plate that is disposed between the movement and the antenna wire in the lateral view, and has an outside diameter that is smaller than an inside diameter of the case on the plane where the conductor plate is disposed;

wherein a distance between the conductor plate and the antenna wire is not greater than 0.1 times the second wavelength of the shortened satellite signals.

2. The timepiece with a wireless function described in claim 1, wherein:

the conductor plate is disposed with the outside edge separated from the inside circumference surface of the case.

3. The timepiece with a wireless function described in claim 1, further comprising:

a spacer intervening between the outside edge of the conductor plate and the inside circumference surface of the case.

4. The timepiece with a wireless function described in claim 1, wherein:

the conductor plate is disposed in contact with the inside circumference surface of the case at one or only two points.

5. The timepiece with a wireless function described in claim 1, further comprising:

a back cover that is attached to the case and is made of a conductive material that functions as a reflector that reflects radio waves.

6. The timepiece with a wireless function described in claim 1, wherein:

the outside diameter of the conductor plate is equal to the outside diameter of the antenna wire or is greater than the outside diameter of the antenna electrode.

7. The timepiece with a wireless function described in claim 1, wherein:

the conductor plate is a dial for displaying time.

8. The timepiece with a wireless function described in claim 1, further comprising:

a transparent dial for displaying time; and a solar panel that is disposed between the dial and the movement, receives light, and generates power;

the conductor plate being a solar panel support substrate that supports the solar panel.

9. The timepiece with a wireless function described in claim 1, further comprising:

a transparent dial for displaying time; and a solar panel that is disposed between the dial and the movement, receives light, and generates power;

the conductor plate being composed of a solar panel support substrate that supports the solar panel, and an annular conductor disposed around the solar panel.

10. The timepiece with a wireless function described in claim 1, wherein:

the antenna wire is disposed on a surface of the dielectric substrate of the antenna opposite the crystal.

11. The timepiece with a wireless function described in claim 1, wherein:

the antenna electrode is C-shaped with an opening formed in one part of its circumference.

12. The timepiece with a wireless function described in claim 1, wherein the conductor plate is configured as part of the antenna.

13. The timepiece with a wireless function described in claim 1, wherein the distance between the conductor plate and the antenna wire is not less than 0.05 times the second wavelength of the shortened satellite signals.

14. The timepiece with a wireless function described in claim 1, wherein the dielectric substrate has a dielectric constant not greater than 20.

15. The timepiece with a wireless function described in claim 14, wherein the dielectric substrate has a dielectric constant not less than 4.

16. The timepiece with a wireless function described in claim 1, wherein the length of the antenna wire is within a range of 1.0 to 1.4 times the second wavelength of the shorted satellite signals.

17. The timepiece with a wireless function described in claim 1, wherein:

the length of the antenna wire is not within a ranged of 1.0 to 1.4 times the first wavelength of the satellite signal transmissions.

18. The timepiece with a wireless function described in claim 17, wherein the antenna is a loop antenna.

19. The timepiece with a wireless function described in claim 1, wherein:

said dielectric substrate is further configured to shorten the wavelength of satellite signal transmissions that pass through it by a predetermined factor to define said shortened satellite signals having said second wavelength, said predetermined factor being dependent upon the dielectric constant of the dielectric substrate.

* * * * *